US006690388B2

(12) United States Patent
Kasahara et al.

(10) Patent No.: US 6,690,388 B2
(45) **Date of Patent: *Feb. 10, 2004**

(54) PDP DISPLAY DRIVE PULSE CONTROLLER

(75) Inventors: Mitsuhiro Kasahara, Hirakata (JP); Yuichi Ishikawa, Ibaraki (JP); Tomoko Morita, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 115 days.

This patent is subject to a terminal disclaimer.

(21) Appl. No.: 09/908,936

(22) Filed: Jul. 20, 2001

(65) Prior Publication Data

US 2002/0036650 A1 Mar. 28, 2002

Related U.S. Application Data

(62) Division of application No. 09/355,339, filed as application No. PCT/JP98/05508 on Dec. 7, 1998.

(30) Foreign Application Priority Data

Dec. 10, 1997 (JP) ..... 9-340418
Sep. 25, 1998 (JP) ..... 10-271995

(51) Int. Cl.[7] ..... G09G 5/20
(52) U.S. Cl. ..... 345/690; 345/691; 345/692; 345/693; 345/39; 345/41; 345/60
(58) Field of Search ..... 345/690, 691, 345/692, 693, 148, 149, 37, 41, 60

(56) References Cited

U.S. PATENT DOCUMENTS 4,890,167 A 12/1989 Nakazato et al. ..... 358/443
5,187,578 A * 2/1993 Kohgami et al. ..... 348/687
5,757,343 A * 5/1998 Nagakubo ..... 345/63
5,943,032 A 8/1999 Nagaoka et al. ..... 345/63
6,034,656 A * 3/2000 Yamamoto et al. ..... 345/60
6,100,859 A 8/2000 Kuriyama et al. ..... 345/60
6,104,362 A 8/2000 Kuriyama et al. ..... 345/63

FOREIGN PATENT DOCUMENTS

| | | |
|---|---|---|
| EP | 0264302 | 4/1988 |
| EP | 0653740 | 5/1995 |
| EP | 0755043 | 1/1997 |
| FR | 2738377 | 3/1997 |
| JP | 6-259034 | 9/1994 |
| JP | 6-348227 | 12/1994 |
| JP | 7-44127 | 2/1995 |
| JP | 7-72825 | 3/1995 |

(List continued on next page.)

OTHER PUBLICATIONS

English Language Abstract of JP 6–259034.
English Language Abstract of JP 8–286636.

(List continued on next page.)

*Primary Examiner*—Matthew Luu
*Assistant Examiner*—Daniel J Chung
(74) *Attorney, Agent, or Firm*—Greenblum & Bernstein, P.L.C.

(57) ABSTRACT

A display apparatus creates, for each image, a number of subfields Z from a first subfield to a Zth subfield in accordance with a Z bit representation of each pixel, a weighing value for each subfield, and a number of gradation display points. The display apparatus detects a peak image brightness level and an average image brightness level. A weighing multiple including a positive integer part and a fractional part is determined based on the peak image brightness level and the average image brightness level. The weighing multiple is multiplied by the weighing value of each subfield to obtain a product capable of having a positive integer part and a fractional part. An integer value near the product is defined as a number of drive pulses for each subfield. The weighing multiple is increased as the average image brightness level decreases and as the peak image brightness level increases.

18 Claims, 24 Drawing Sheets

FOREIGN PATENT DOCUMENTS

| | | |
|---|---|---|
| JP | 7-140928 | 6/1995 |
| JP | 8-286636 | 11/1996 |
| JP | 8-305321 | 11/1996 |
| JP | 9-127911 | 5/1997 |
| JP | 10187084 | 7/1998 |
| JP | 10207426 | 8/1998 |
| JP | 10282929 | 10/1998 |

OTHER PUBLICATIONS

Partial English Language Translation of JP 10–282929.
Partial English Language Translation of JP 10–207426.
Partial English Language Translation of JP 8–286636.
English Language Abstract of JP 10–187084.
English Language Abstract of JP 8–305321.
English Language Abstract of JP 6–348227.
English Language Abstract of JP 7–44127.
English language abstract of JP 8–286636.
English language abstract of JP 9–127911.
English language abstract of JP 10–282929.
English language abstract of JP 10–207426.
English language abstract of JP 7–72825 and partial translation of the same.
English language abstract of JP 6–259034.
"New Category Contour Noise Observed in Pulse–Width-Modulated Moving Images", T. Masuda et al., ITEJ Tech. Report, vol. 19, No. 2, IDY95–21, published on Jan. 19, 1995, with English Translation.

* cited by examiner

Fig.1A

SF1

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 0 | 0 | 0 | 0 | 0 | 0 | 0 | 0 |
| 0 | 1 | 0 | 1 | 1 | 1 | 0 | 0 | 0 | 0 |

Fig.1B

SF2

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 0 | 0 | 0 | 0 | 0 | 0 | 0 |

Fig.1C

SF3

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1D

SF4

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1E

SF5

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1F

SF6

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1G

SF7

| | | | | | | | | | |
|---|---|---|---|---|---|---|---|---|---|
| 0 | 0 | 0 | 0 | 0 | 0 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |
| 0 | 1 | 1 | 1 | 1 | 1 | 0 | 0 | 0 | 0 |

Fig.1H

SF8

| | | | | | | | | | |
|---|---|---|---|---|---|---|---|---|---|
| 1 | 1 | 1 | 1 | 1 | 1 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |

1-TIMES MODE
8 SUBFIELDS
256 GRADATIONS

DIVIDED IN 2

1-TIMES MODE
9 SUBFIELDS
256 GRADATIONS

FIXED MULTIPLICATION FACTOR
A
3.0
2.5
2.0
1.5
1.0
0.5
C19
C18
C17
C16
C15
C14
C13
C12
C11
3.00/ 1.00
3.00/ 2.00
3.00/ 3.00
255 1.00-TIMES 12 SUBFIELDS
255 1.25-TIMES 12 SUBFIELDS
255 1.50-TIMES 12 SUBFIELDS
255 1.75-TIMES 12 SUBFIELDS
255 2.00-TIMES 12 SUBFIELDS
255 2.25-TIMES 11 SUBFIELDS
255 2.50-TIMES 11 SUBFIELDS
255 2.75-TIMES 11 SUBFIELDS
255 3.00-TIMES 11 SUBFIELDS
A
K
N
Z
1.00/ 3.00
1.25/ 3.00
1.50/ 3.00
1.75/ 3.00
2.00/ 3.00
2.25/ 3.00
2.50/ 3.00
2.75/ 3.00
100%
PEAK LEVEL
Lpk

Fig.22A

[0] EXAMPLE OF 0000

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Fig.22B

[2] EXAMPLE OF 0010

| | | | |
|---|---|---|---|
| 0 | 0 | 0 | 0 |
| 0 | 0 | 1 | 0 |
| 0 | 0 | 0 | 0 |
| 1 | 0 | 0 | 0 |

Fig.22C

[4] EXAMPLE OF 0100

| | | | |
|---|---|---|---|
| 0 | 0 | 0 | 0 |
| 1 | 0 | 1 | 0 |
| 0 | 0 | 0 | 0 |
| 1 | 0 | 1 | 0 |

Fig.22D

[06] EXAMPLE OF 0110

| | | | |
|---|---|---|---|
| 0 | 0 | 0 | 1 |
| 1 | 0 | 1 | 0 |
| 0 | 1 | 0 | 0 |
| 1 | 0 | 1 | 0 |

Fig.22E

[8] EXAMPLE OF 1000

| | | | |
|---|---|---|---|
| 0 | 1 | 0 | 1 |
| 1 | 0 | 1 | 0 |
| 0 | 1 | 0 | 1 |
| 1 | 0 | 1 | 0 |

Fig.22F

[10] EXAMPLE OF 1010

| | | | |
|---|---|---|---|
| 0 | 1 | 0 | 1 |
| 1 | 0 | 1 | 1 |
| 0 | 1 | 0 | 1 |
| 1 | 1 | 1 | 0 |

Fig.22G

[12] EXAMPLE OF 10100

| | | | |
|---|---|---|---|
| 0 | 1 | 0 | 1 |
| 1 | 1 | 1 | 1 |
| 0 | 1 | 0 | 1 |
| 1 | 1 | 1 | 1 |

Fig.22H

[14] EXAMPLE OF 1110

| | | | |
|---|---|---|---|
| 0 | 1 | 1 | 1 |
| 1 | 1 | 1 | 1 |
| 1 | 1 | 0 | 1 |
| 1 | 1 | 1 | 1 |

ERROR ACCUMULATION

ERROR DIFFUSION

Fig.25A

| | X=0 | 1 | 2 | 3 | 4 | 5 | 6 | 7 | 8 | 9 | 10 |
|---|---|---|---|---|---|---|---|---|---|---|---|
| Y=0 | 8 | 8 | 8 | 8 | 8 | 8 | 8 | 8 | 8 | 8 | 8 |
| 1 | 8 | 8 | 8 | 8 | 8 | 8 | 8 | 8 | 8 | 8 | 8 |
| 2 | 8 | 8 | 8 | 8 | 8 | 8 | 8 | 8 | 8 | 8 | 8 |
| 3 | 8 | 8 | 8 | 8 | 8 | 8 | 8 | 8 | 8 | 8 | 8 |
| 4 | 8 | 8 | 8 | 8 | 8 | 8 | 8 | 8 | 8 | 8 | 8 |
| 5 | 8 | 8 | 8 | 8 | 8 | 8 | 8 | 8 | 8 | 8 | 8 |
| 6 | 8 | 8 | 8 | 8 | 8 | 8 | 8 | 8 | 8 | 8 | 8 |
| 7 | 8 | 8 | 8 | 8 | 8 | 8 | 8 | 8 | 8 | 8 | 8 |
| 8 | 8 | 8 | 8 | 8 | 8 | 8 | 8 | 8 | 8 | 8 | 8 |
| 9 | 8 | 8 | 8 | 8 | 8 | 8 | 8 | 8 | 8 | 8 | 8 |
| 10 | 8 | 8 | 8 | 8 | 8 | 8 | 8 | 8 | 8 | 8 | 8 |

Fig.25B

| | X=0 | 1 | 2 | 3 | 4 | 5 | 6 | 7 | 8 | 9 | 10 |
|---|---|---|---|---|---|---|---|---|---|---|---|
| Y=0 | 0 | 0 | 0 | 0 | 0 | 0 | 0 | 0 | 0 | 0 | 0 |
| 1 | 0 | 1 | 0 | 1 | 0 | 1 | 0 | 1 | 0 | 1 | 0 |
| 2 | 0 | 1 | 0 | 1 | 0 | 1 | 0 | 1 | 0 | 1 | 0 |
| 3 | 0 | 0 | 0 | 0 | 0 | 0 | 0 | 0 | 0 | 0 | 0 |
| 4 | 0 | 1 | 1 | 1 | 1 | 1 | 1 | 1 | 1 | 1 | 1 |
| 5 | 0 | 0 | 0 | 0 | 0 | 0 | 0 | 0 | 0 | 0 | 0 |
| 6 | 0 | 1 | 0 | 1 | 0 | 1 | 0 | 1 | 0 | 1 | 0 |
| 7 | 0 | 1 | 0 | 1 | 0 | 1 | 0 | 1 | 0 | 1 | 0 |
| 8 | 0 | 0 | 0 | 0 | 0 | 0 | 0 | 0 | 0 | 0 | 0 |
| 9 | 0 | 1 | 1 | 1 | 1 | 1 | 1 | 1 | 1 | 1 | 1 |
| 10 | 0 | 0 | 0 | 0 | 0 | 0 | 0 | 0 | 0 | 0 | 0 |

Fig.25C

| | X=0 | 1 | 2 | 3 | 4 | 5 | 6 | 7 | 8 | 9 | 10 |
|---|---|---|---|---|---|---|---|---|---|---|---|
| Y=0 | 8 | 10 | 10 | 10 | 10 | 10 | 10 | 10 | 10 | 10 | 10 |
| 1 | 12 | 17 | 14 | 17 | 14 | 17 | 14 | 17 | 14 | 17 | 14 |
| 2 | 11 | 16 | 11 | 16 | 11 | 16 | 11 | 16 | 11 | 16 | 11 |
| 3 | 10 | 14 | 13 | 15 | 13 | 15 | 13 | 15 | 13 | 15 | 13 |
| 4 | 13 | 19 | 17 | 17 | 17 | 17 | 17 | 17 | 17 | 17 | 17 |
| 5 | 11 | 13 | 11 | 10 | 10 | 10 | 10 | 10 | 10 | 10 | 10 |
| 6 | 13 | 18 | 15 | 17 | 14 | 17 | 14 | 17 | 14 | 17 | 14 |
| 7 | 11 | 16 | 11 | 16 | 11 | 16 | 11 | 16 | 11 | 16 | 11 |
| 8 | 10 | 14 | 13 | 15 | 13 | 15 | 13 | 15 | 13 | 15 | 13 |
| 9 | 13 | 19 | 17 | 17 | 17 | 17 | 17 | 17 | 17 | 17 | 17 |
| 10 | 11 | 13 | 11 | 10 | 10 | 10 | 10 | 10 | 10 | 10 | 10 |

PDP DISPLAY DRIVE PULSE CONTROLLER

CROSS REFERENCE TO RELATED APPLICATION

This is a divisional of U.S. application Ser. No. 09/355,339, filed Aug. 5, 1999, which is the National Stage of International Application No. PCT/JP98//05508, filed Dec. 7, 1998, the contents of which are expressly incorporated by reference herein in their entireties. The International Application was published under PCT 21 (2) in English.

TECHNICAL FIELD

The present invention relates to a display apparatus, and more specifically, to a plasma display panel (PDP) and digital micromirror device (DMD) display drive pulse controller.

BACKGROUND ART

A display apparatus of a PDP and a DMD makes use of a subfield method, which has binary memory, and which displays a dynamic image possessing half tones by temporally superimposing a plurality of binary images that have each been weighted. The following explanation deals with PDP, but applies equally to DMD as well.

A PDP subfield method is explained using FIGS. 1, 2, and 3.

Now, consider a PDP with pixels lined up 10 across and 4 vertically, as shown in FIG. 3. Let the respective R,G,B of each pixel be 8 bits, assume that the brightness thereof is rendered, and that a brightness rendering of 256 gradations (256 gray scales) is possible. The following explanation, unless otherwise stated, deals with a G signal, but the explanation applies equally to R, B as well.

The portion indicated by A in FIG. 3 has a signal level of brightness of 128. If this is displayed in binary, a (1000 0000) signal level is added to each pixel in the portion indicated by A. Similarly, the portion indicated by B has a brightness of 127, and a (0111 1111) signal level is added to each pixel. The portion indicated by C has a brightness of 126, and a (0111 1110) signal level is added to each pixel. The portion indicated by D has a brightness of 125, and a (0111 1101) signal level is added to each pixel. The portion indicated by E has a brightness of 0, and a (0000 0000) signal level is added to each pixel. Lining up an 8-bit signal for each pixel perpendicularly in the location of each pixel, and horizontally slicing it bit-by-bit produces a subfield. That is, in an image display method, which utilizes the so-called subfield method, by which 1 field is divided into a plurality of differently weighted binary images, and displayed by temporally superimposing these binary images, a subfield is 1 of the divided binary images.

Since each pixel is displayed using 8 bits, as shown in FIG. 2, 8 subfields can be achieved. Collect the least significant bit of the 8-bit signal of each pixel, line them up in a 10×4 matrix, and let that be subfield SF1 (FIG. 2). Collect the second bit from the least significant bit, line them up similarly into a matrix, and let this be subfield SF2. Doing this creates subfields SF1, SF2, SF3, SF4, SF5, SF6, SF7, SF8. Needless to say, subfield SF8 is formed by collecting and lining up the most significant bits.

FIG. 4 shows the standard form of a 1 field PDP driving signal. As shown in FIG. 4, there are 8 subfields SF1, SF2, SF3, SF4, SF5, SF6, SF7, SF8 in the standard form of a PDP driving signal, and subfields SF1 through SF8 are processed in order, and all processing is performed within 1 field time.

The processing of each subfield is explained using FIG. 4. The processing of each subfield constitutes setup period P1, write period P2 and sustain period P3. At setup period P1, a single pulse is applied to a sustaining electrode, and a single pulse is also applied to each scanning electrode (There are only up to 4 scanning electrodes indicated in FIG. 4 because there are only 4 scanning lines shown in the example in FIG. 3, but in reality, there are a plurality of scanning electrodes, 480, for example.). In accordance with this, preliminary discharge is performed.

At write period P2, a horizontal-direction scanning electrodes scans sequentially, and a predetermined write is performed only to a pixel that received a pulse from a data electrode. For example, when processing-subfield SF1, a write is performed for a pixel represented by "1" in subfield SF1 depicted in FIG. 2, and a write is not performed for a pixel represented by "0."

At sustain period P3, a sustaining pulse (driving pulse) is outputted in accordance with the weighting value of each subfield. For a written pixel represented by "1," a plasma discharge is performed for each sustaining pulse, and the brightness of a predetermined pixel is achieved with one plasma discharge. In subfield SF1, since weighting is "1," a brightness level of "1" is achieved. In subfield SF2, since weighting is "2," a brightness level of "2" is achieved. That is, write period P2 is the time when a pixel which is to emit light is selected, and sustain period P3 is the time when light is emitted a number of times that accords with the weighting quantity.

As shown in FIG. 4, subfields SF1, SF2, SF3, SF4, SF5, SF6, SF7, SF8 are weighted at 1, 2, 4, 8, 16, 32, 64, 128, respectively. Therefore, the brightness level of each pixel can be adjusted using 256 gradations, from 0 to 255.

In the B region of FIG. 3, light is emitted in subfields SF1, SF2, SF3, SF4, SF5, SF6, SF7, but light is not emitted in subfield SF8. Therefore, a brightness level of "127"(=1+2+4+8+16+32+64) is achieved.

And in the A region of FIG. 3, light is not emitted in subfields SF1, SF2, SF3, SF4, SF5, SF6, SF7, but light is emitted in subfield SF8. Therefore, a brightness level of "128" is achieved.

For a screen with overall bright luminance, it is possible to create a bright picture even using as-is a drive pulse acquired from a picture signal, but if an image becomes dark overall, when a drive pulse acquired from a picture signal is used as-is, it results in an extremely dark screen, and a weak picture rendition. The structure of the human eye is such that in bright places the pupil becomes smaller, reducing the amount of light that enters, but when it becomes dark, the pupil continuously enlarges so as to take in more light. To achieve the same effect thereas, there is a well-known method, by which, when a screen darkens overall, a drive pulse number is increased at the same ratio over the entire screen, making an entire screen bright, and rendering a robust picture while maintaining a dark atmosphere.

With regard to the brightness of an overall screen, there is a well-known method, which divides the transition from a bright situation to a dark situation into a plurality of stages, for example, 3 stages, bright, rather bright, dark, and for a bright situation utilizes a 1-times mode (FIG. 4), which uses a drive pulse as-is, for a rather bright situation, utilizes a 2-times mode (FIG. 6), which doubles a drive pulse, and for a dark situation, utilizes a 3-times mode (FIG. 7), which triples a drive pulse This is disclosed, for example, in the Japanese Patent specification of Kokai No. (1996)-286636 (corresponding to the specification of U.S. Pat. No. 5,757,343).

Thus, since a drive pulse is changed in stages, when a screen changes from a certain stage to another stage, for example, from rather bright to dark, an abrupt change is displayed on a screen, occasioning a sense of incongruousness.

A well-known approach is to adjust a fixed multiplication factor of gain with an object of doing away with the abrupt change of this screen, and performing continuous luminance adjustment (For example, the specification of Kokai No. (1996)-286636 (corresponding to the specification of U.S. Pat. No. 5,757,343)). The problem has been that even if a fixed multiplication factor of gain is changed, since a drive pulse is changed in stages to 2-times, 3-times, the sense of incongruousness of the screen at the point in time when the change occurs cannot be fully eliminated.

The present invention is designed to solve this problem, and has as a first object the provision of a PDP display pulse drive controller, which is capable of performing adjustments by changing a drive pulse using not only an integer multiplier, but also a multiplier of a value comprising a fraction, and of performing more continuous luminance adjustment.

An average level, peak level of brightness, PDP power consumption, panel temperature, contrast and such are used as parameters for rendering image brightness.

Performing adjustments by changing a drive pulse using not only an integer multiplier, but also a multiplier of a value comprising a fraction enables screen brightness adjustment that continuously brightens without intermittent brightness, so that a person watching a screen does not notice a change in brightness.

Further, the present invention has as a second object the provision of a PDP display drive pulse controller, which is capable of adjusting a subfield number in accordance with the brightness of an image (including both a dynamic image and a static image).

Increasing a subfield number makes it possible to do away with pseudo-contour lines, which are explained below. Conversely, decreasing a subfield number, while running the risk of generating pseudo-contour lines, makes it possible to create a clearer image.

Pseudo-contour noise is explained below.

Assume that regions A, B, C, D from the state shown in FIG. 3 have been moved 1 pixel width to the right as shown in FIG. 5. Thereupon, the viewpoint of the eye of a person looking at the screen also moves to the right so as to follow regions A, B, C, D. Thereupon, 3 vertical pixels in region B (the B1 portion of FIG. 3) will replace 3 vertical pixels in region A (A1 portion of FIG. 5) after I field. Then, at the point in time when the displayed image changes from FIG. 3 to FIG. 5, the eye of a human being is cognizant of region B1, which takes the form of a logical product (AND) of B1 region data (01111111) and A1 region data (10000000), that is (00000000). That is, the B1 region is not displayed at the original 127 level of brightness, but rather, is displayed at a brightness level of 0. Thereupon, an apparent dark borderline appears in region B1. If an apparent change from "1" to "0" is applied to an upper bit like this, an apparent dark borderline appears.

Conversely, when an image changes from FIG. 5 to FIG. 3, at the point in time when it changes to FIG. 3, a viewer is cognizant of region A1, which takes the form of a logical sum (OR) of A1 region data (10000000) and B1 region data (01111111), that is (11111111). That is, the most significant bit is forcibly changed from "0" to "1," and in accordance with this, the A1 region is not displayed at the original 128 level of brightness, but rather, is displayed at a roughly 2-fold brightness level of 255. Thereupon, an apparent bright borderline appears in region A1. If an apparent change from "0" to "1" is applied to an upper bit like this, an apparent bright borderline appears.

In the case of a dynamic image only, a borderline such as this that appears on a screen is called pseudo-contour noise ("pseudo-contour noise seen in a pulse width modulated motion picture display": Television Society Technical Report, Vol. 19, No. 2, IDY95-21 pp. 61–66), causing degradation of image quality.

Disclosure of Invention

According to the present invention, a display apparatus creates, for each picture, Z subfields from a first to a Zth in accordance with Z bit representation of each pixel, a weighting value for weighting to each subfield, a multiplication factor A for amplifying a picture signal, and a number of gradation display points K, said display apparatus, comprising:

brightness detecting means for obtaining image brightness data; and adjusting means for adjusting a weighting multiplier N, by which said weighting value is multiplied, on the basis of the brightness data, said weighting multiplier N comprising a positive integer, and a decimal fraction numerical value.

According to a preferred embodiment, said brightness detecting means comprises average level detecting means, which detect an average level (Lav) of image brightness.

According to a preferred embodiment, said brightness detecting means comprises peak level detecting means, which detect a peak level (Lpk) of image brightness.

According to a preferred embodiment, said adjusting means comprises image characteristic determining means, which decide a fixed multiplication factor A, which brightens or darkens the brightness of an entire image by amplifying a picture signal, and multiplication means (12), which amplify a picture signal A times based on fixed multiplication factor A.

According to a preferred embodiment, said adjusting means comprises image characteristic determining means, which decide total number of gradations K, and display gradation adjusting means, which change a picture signal to the nearest gradation level based on total number of gradations K.

According to a preferred embodiment, said adjusting means comprises image characteristic determining means, which decide a subfield number Z, and corresponding means, which decide a weighting of each subfield on the basis of the subfield number Z.

According to a preferred embodiment, the weighting multiplier N is increased as said average brightness level (Lav) decreases.

According to a preferred embodiment, the subfield number Z is reduced as said average brightness level (Lav) decreases.

According to a preferred embodiment, the fixed multiplication factor A is increased as said average brightness level (Lav) decreases.

According to a preferred embodiment, the multiplication result of the fixed multiplication factor A and weighting multiplier N is increased as said average brightness level (Lav) decreases.

According to a preferred embodiment, the weighting multiplier N is reduced as said peak brightness level (Lpk) decreases.

According to a preferred embodiment, the subfield number Z is increased as said peak brightness level (Lpk) decreases.

According to a preferred embodiment, the fixed multiplication factor A is increased as said peak brightness level (Lpk) decreases.

According to a preferred embodiment, said brightness detecting means comprises contrast detecting means, which detect image contrast.

According to a preferred embodiment, said brightness detecting means comprises ambient illumination detecting means, which detect ambient illumination, where a display apparatus is located.

According to a preferred embodiment, said brightness detecting means comprises power consumption detecting means, which detect display panel power consumption of a display apparatus.

According to a preferred embodiment, said brightness detecting means comprises temperature detecting means, which detect display panel temperature of a display apparatus.

According to a preferred embodiment, the weighting value of each subfield Q is multiplied by a weighting multiplier N of each subfield, and an integer value obtained by rounding off to a decimal place the product thereof is used as a number of light emissions of each subfield.

According to a preferred embodiment, the apparatus further comprises means for generating for each gradation correction data that accords with an error between a luminance of an image to be displayed, and displayable luminance in accordance with the number of light emissions of each subfield, and means for changing a spatial density of a gradation, which is displayed in accordance with this correction data.

According to a preferred embodiment, said correction data generating means is constituted from a correction data conversion table, a correction data of which is correspondent to each gradation.

According to a preferred embodiment, said means for changing spatial density actuates only a low luminance portion.

According to a preferred embodiment, said means for changing spatial density comprise a dither circuit.

According to a preferred embodiment, said means for changing spatial density is an error diffusing circuit.

BRIEF DESCRIPTION OF DRAWINGS

FIGS. 1A to 1H illustrate diagrams of subfields SF1–SF8.

FIGS. 22A, 22B, 22C, 22D, 22E, 22F, 22G and 22H are diagrams showing operation of dither circuit;

FIGS. 25A, 25B and 25C are diagrams showing operations of error diffusing circuit.

BEST MODE FOR CARRYING OUT THE INVENTION

Figure 2:
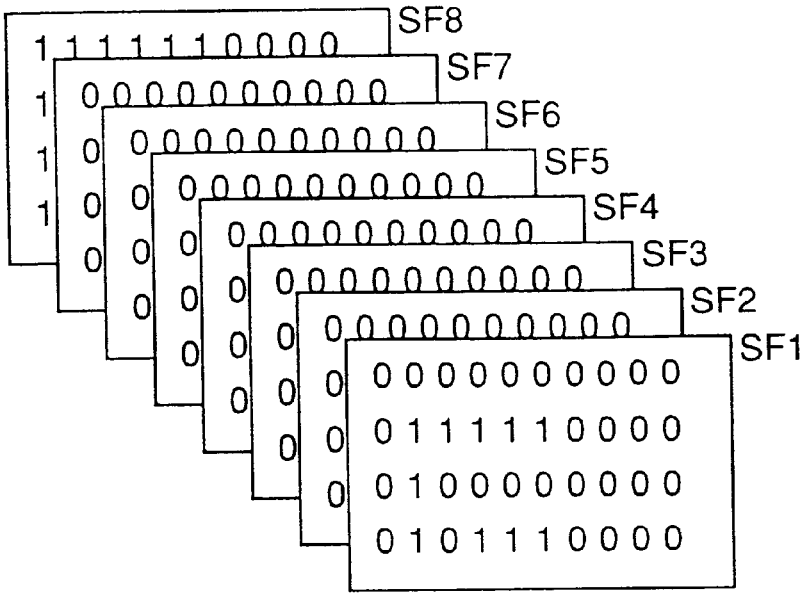
FIG. 2 illustrates a diagram in which subfields SF1–SF8 overlay one another.
Figure 3:
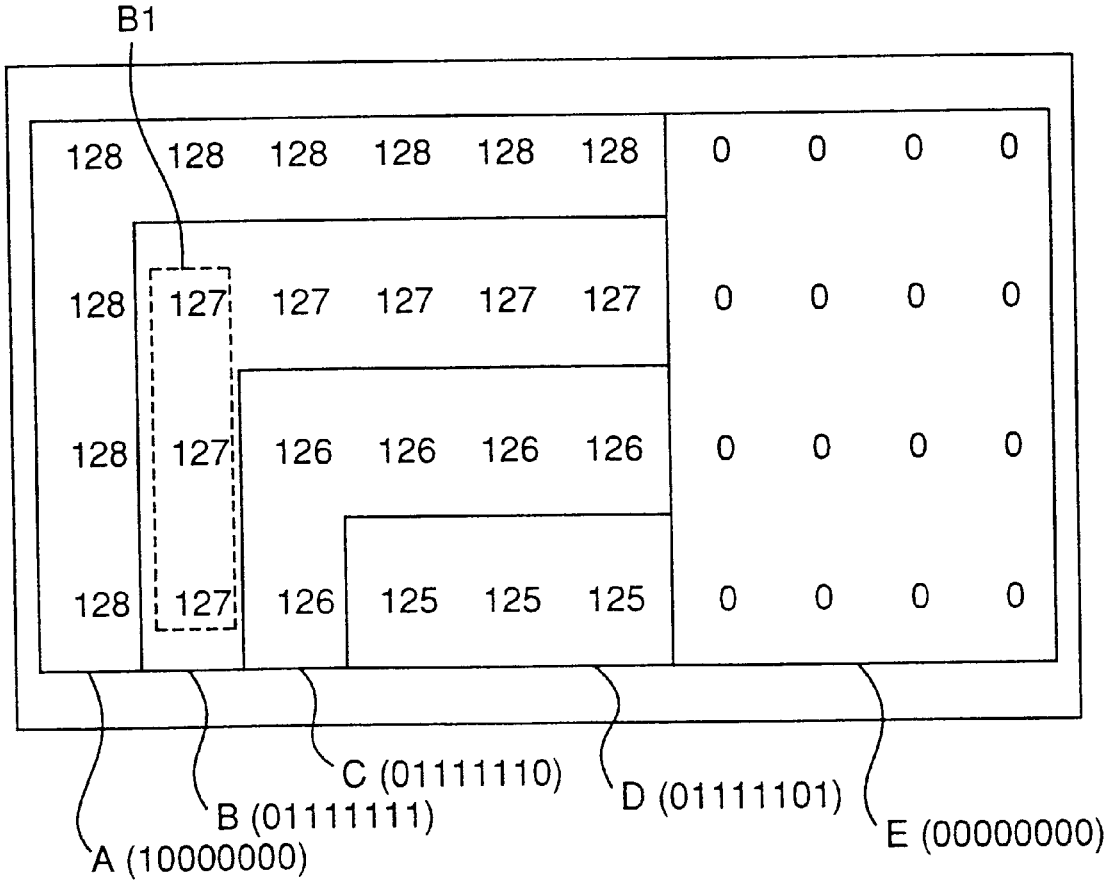
FIG. 3 shows a diagram of an example of PDP screen brightness distribution.
Figure 4:
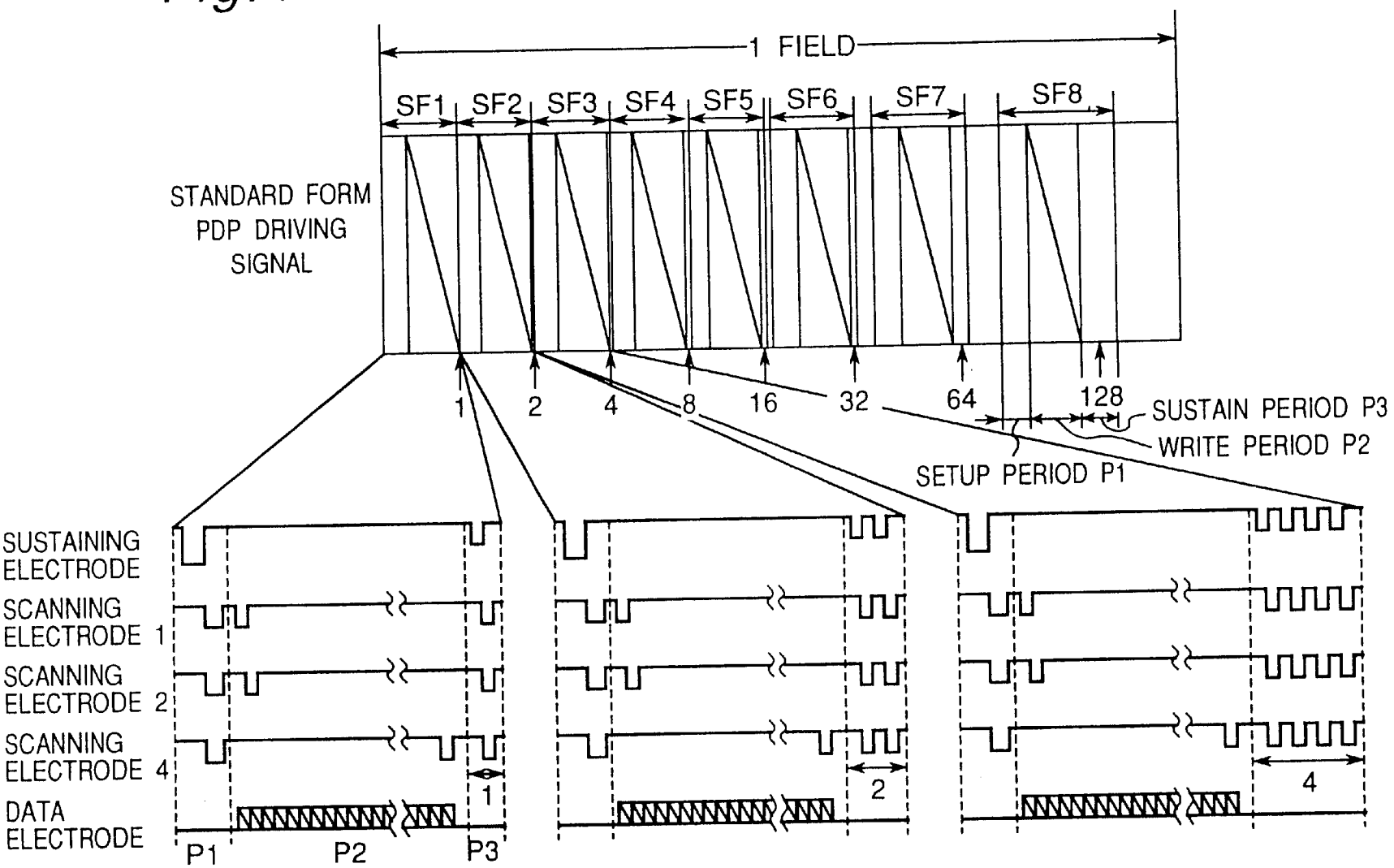
FIG. 4 shows a waveform diagram showing the standard form of a PDP driving signal.

Prior to entering into an explanation of the embodiments of the present invention, a number of variations of the standard form of a PDP driving signal depicted in FIG. 4 are described.

Figure 6:
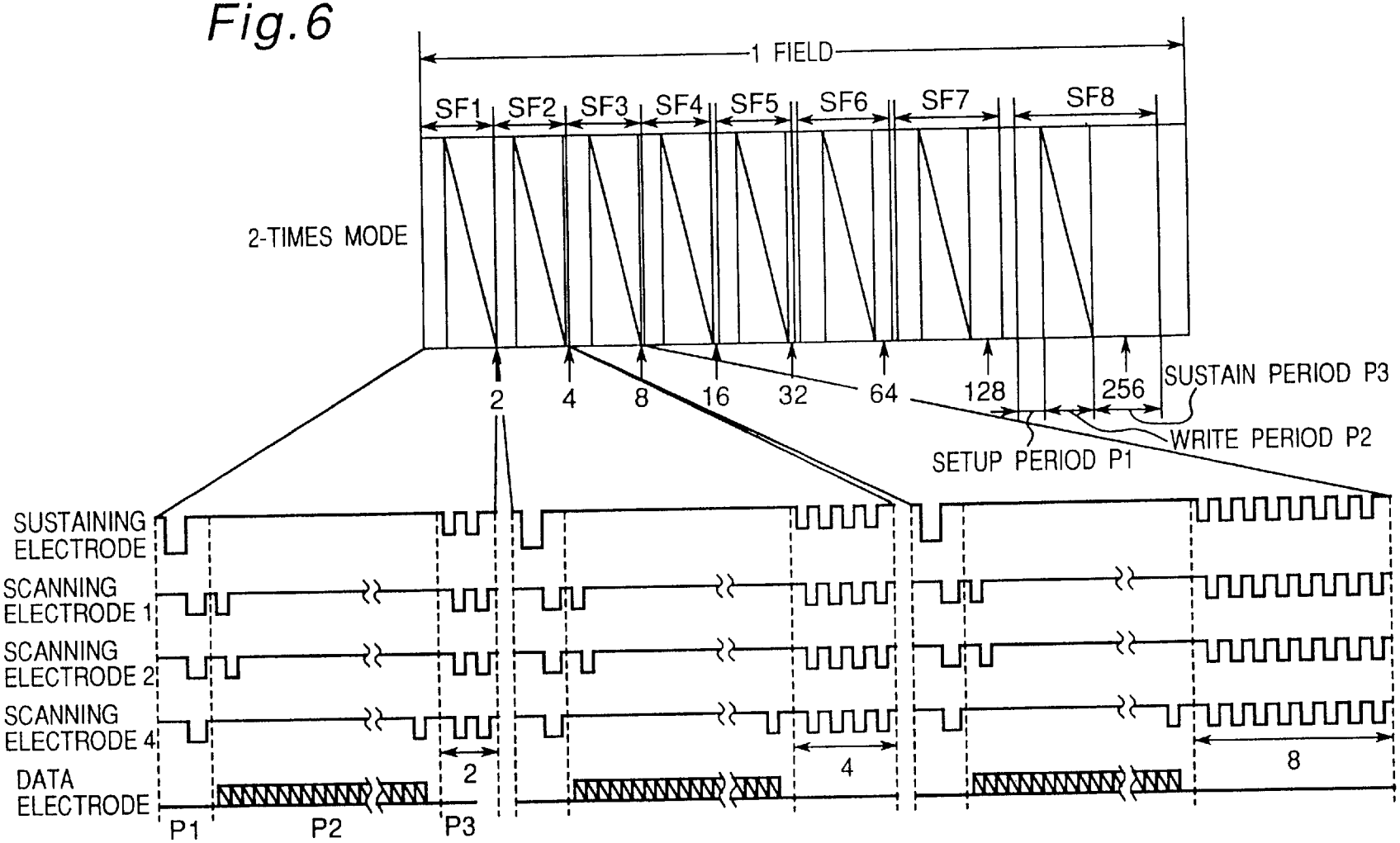
FIG. 6 shows a waveform diagram showing a 2-times mode of a PDP driving signal.

FIG. 6 shows a 2-times mode PDP driving signal, for which a weighting value is doubled, i.e., the multiplier N is 2. Furthermore, the PDP driving signal shown in FIG. 4 is a 1-times mode. With the 1-times mode of FIG. 4, the number of sustaining pulses contained in sustain period P3 for subfields SF1 through SF8, that is, the weighting values, were 1, 2, 4, 8, 16, 32, 64, 128, respectively, but with the 2-times mode of FIG. 6, the number of sustaining pulses contained in sustain period P3 for subfields SF1 through SF8 are double weighted, more specifically, they become 2, 4, 8, 16, 32, 64, 128, 256, respectively. In accordance with this, compared to a standard form PDP driving signal, which is a 1-times mode, a 2-times mode PDP driving signal can produce an image display with 2 times the brightness.

Figure 7:
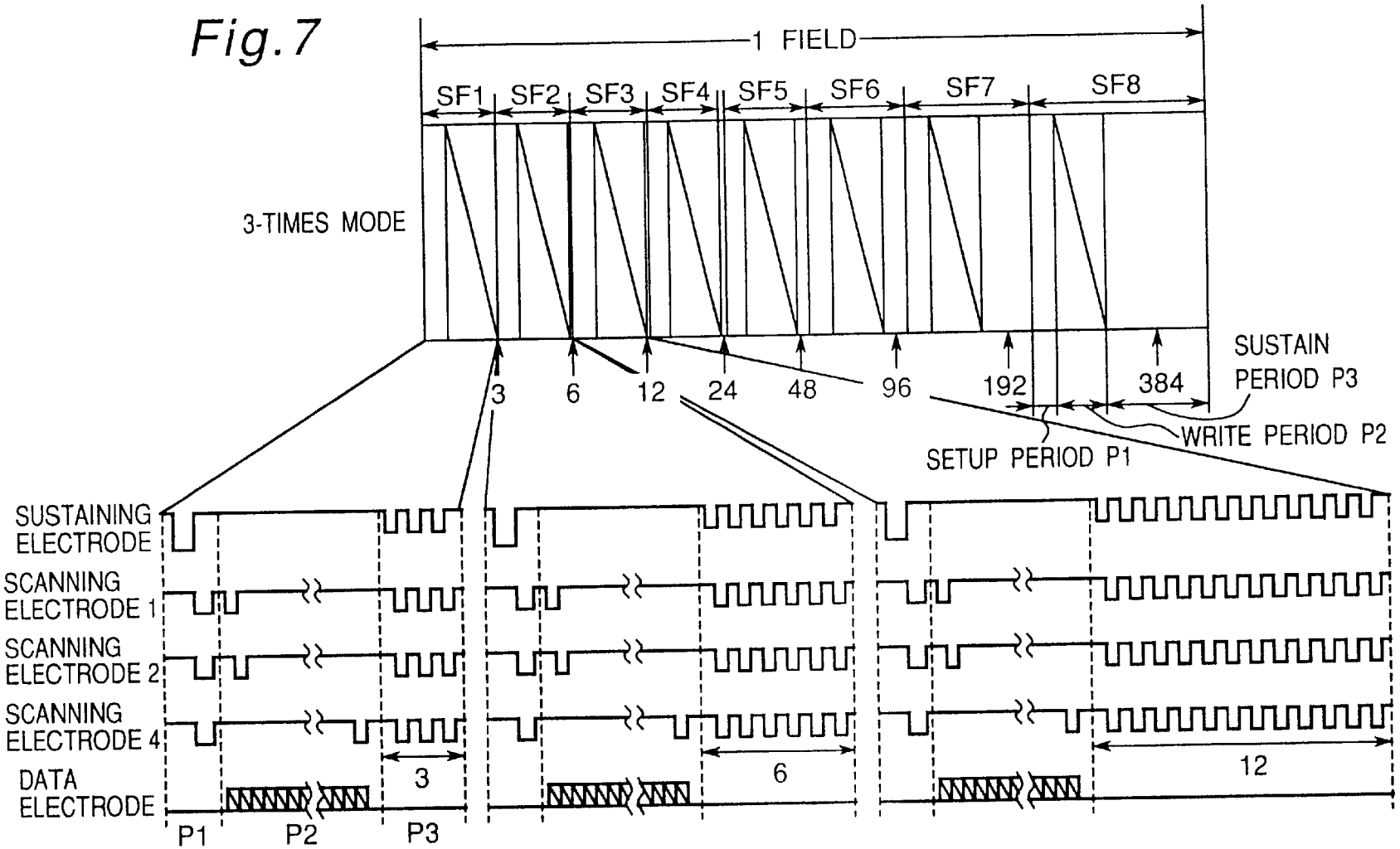
FIG. 7 shows a waveform diagram showing a 3-times mode of a PDP driving signal.

FIG. 7 shows a 3-times mode PDP driving signal, for which a weighting value is tripled, i.e., the multiplier N is 3. Therefore, the number of sustaining pulses contained in sustain period P3 for subfields SF1 through SF8 become 3, 6, 12, 24, 48, 96, 192, 384, respectively, tripling for all subfields.

In this way, although dependent on the degree of margin in 1 field, it is possible to create a maximum 6-times mode PDP driving signal. In accordance with this, it is possible to produce an image display with 6 times the brightness.

In the present invention, in addition to the above-described integer multiplier mode, a weighting multiplier N can also be a mode of a value comprising a fraction, for example, a 1.25-times mode, 1.50-times mode, 1.75-times mode. A detailed explanation of such modes is provided below.

Figure 8A:
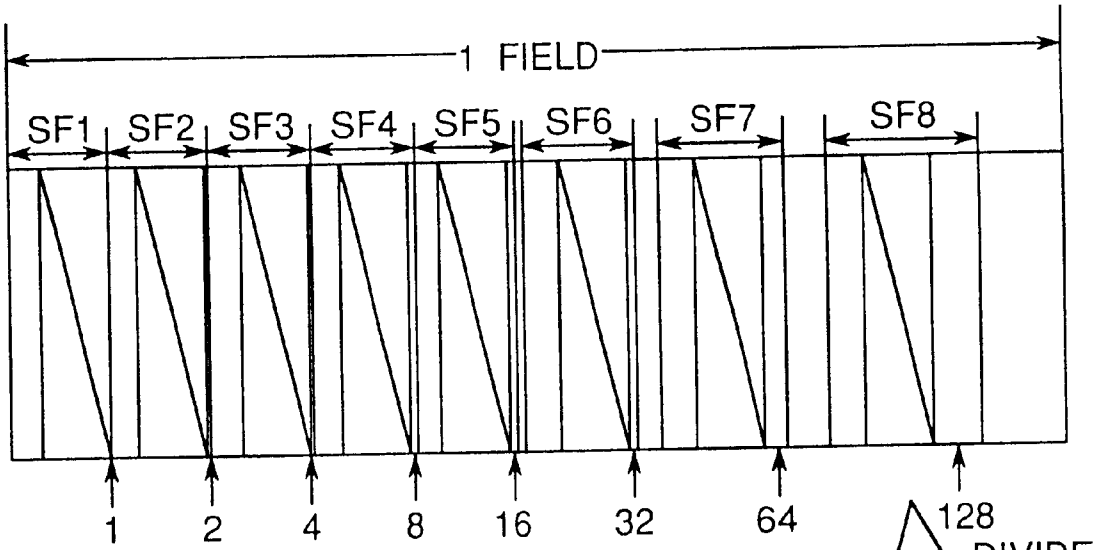
FIG. 8A shows a waveform diagram of a standard form of PDP driving signal.
Figure 8B:
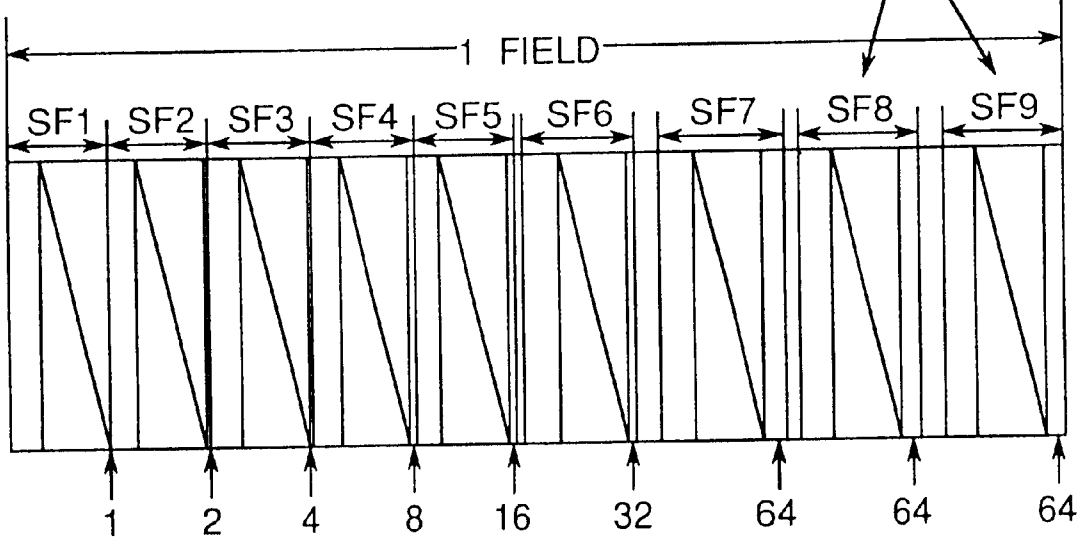
FIG. 8B shows a waveform diagram similar to that shown in FIG. 8A, but has subfields increase by one.

FIG. 8 (A) shows a standard form PDP driving signal, and FIG. 8 (B) shows a variation of a PDP driving signal, to which 1 subfield has been added, and which has subfields SF1 through SF9. For the standard form, the final subfield SF8 is weighted by 128 sustaining pulses, and for the variation of FIG. 8 (B), each of the last 2 subfields SF8, SF9 are weighted by 64 sustaining pulses. For example, when a brightness level of 130 is to be displayed, with the standard form of FIG. 8 (A), this can be achieved using both subfield SF2 (weighted 2) and subfield SF8 (weighted 128), whereas with the variation of FIG. 8 (B), this brightness level can be achieved using 3 subfields, subfield SF2 (weighted 2), subfield SF8 (weighted 64), and subfield SF9 (weighted 64). By increasing the number of subfields in this way, it is possible to decrease the weighting value of the subfield with the greatest weighting value. Decreasing weighting value in this manner enables a proportional reduction in pseudo-contour noise.

Table 1, Table 2, Table 3, Table 4 shown below list the weighting value of a subfield, the light emission number of a subfield, the difference of number of light emissions between adjacent modes, and a percentage display of such differences, when the weighting multiplier N of respective PDP driving signals is 1.00-times mode, 1.25-times mode, 1.50-times mode, 1.75-times mode, 2.00-times mode, 2.25-times mode, 2.50-times mode, 2.75-times mode, 3.00-times mode.

Furthermore, the relationship between weighting value Q, weighting multiplier N (or N of N-times mode), number of light emissions E, in principle, is as follows.

$$E=Q\times N$$

In the present invention, since there are also cases in which a weighting multiplier N comprises a fractional value, such as 2.75, for example, there will also be cases in which the number of light emissions E is not an integer value, but rather one that comprises a fraction value. For cases such as this, the fractional value of the number of light emissions will either be rounded to the nearest whole number, omitted (rounded to the next lowest integer) or carried over (rounded to the next highest integer). Therefore, the number of light emissions is always an integer value.

TABLE 1

| N | K | Weighting value Q | | | | | | | | | | | | Total |
|---|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 | |
| 1.00 | 255 | 1 | 1 | 1 | 4 | 8 | 13 | 19 | 26 | 35 | 42 | 49 | 56 | 255 |
| | | | SF1 | SF2 | SF3 | SF4 | SF5 | SF6 | SF7 | SF8 | SF9 | SF10 | SF11 | |
| 1.25 | 255 | — | 1 | 2 | 4 | 8 | 12 | 19 | 26 | 35 | 42 | 49 | 57 | 255 |
| 1.50 | 255 | — | 1 | 2 | 3 | 6 | 10 | 18 | 27 | 35 | 43 | 51 | 59 | 255 |
| 1.75 | 255 | — | 1 | 1 | 2 | 5 | 9 | 17 | 28 | 36 | 44 | 52 | 60 | 255 |
| 2.00 | 255 | — | 1 | 1 | 1 | 4 | 8 | 16 | 28 | 36 | 45 | 53 | 62 | 255 |
| | | | | SF1 | SF2 | SF3 | SF4 | SF5 | SF6 | SF7 | SF8 | SF9 | SF10 | |
| 2.25 | 255 | — | — | 1 | 2 | 4 | 8 | 16 | 27 | 36 | 45 | 53 | 63 | 255 |
| 2.50 | 255 | — | — | 1 | 2 | 4 | 8 | 16 | 26 | 35 | 45 | 54 | 64 | 255 |
| 2.75 | 255 | — | — | 1 | 2 | 4 | 8 | 16 | 25 | 35 | 44 | 55 | 65 | 255 |
| 3.00 | 255 | — | — | 1 | 2 | 4 | 8 | 16 | 25 | 34 | 44 | 55 | 66 | 255 |

TABLE 2

| N | K | Number of Light Emissions E | | | | | | | | | | | | Total |
|---|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 | |
| 1.00 | 255 | 1 | 1 | 1 | 4 | 8 | 13 | 19 | 26 | 35 | 42 | 49 | 56 | 255 |
| | | | SF1 | SF2 | SF3 | SF4 | SF5 | SF6 | SF7 | SF8 | SF10 | SF11 | | |
| 1.25 | 255 | — | 1 | 3 | 5 | 10 | 15 | 24 | 33 | 44 | 53 | 61 | 71 | 320 |
| 1.50 | 255 | — | 2 | 3 | 5 | 9 | 15 | 27 | 41 | 53 | 65 | 77 | 89 | 386 |
| 1.75 | 255 | — | 2 | 2 | 4 | 9 | 16 | 30 | 49 | 63 | 77 | 91 | 105 | 448 |
| 2.00 | 255 | — | 2 | 2 | 2 | 8 | 16 | 32 | 56 | 72 | 90 | 106 | 124 | 510 |
| | | | | SF1 | SF2 | SF3 | SF4 | SF5 | SF6 | SF7 | SF8 | SF9 | SF10 | |
| 2.25 | 255 | — | — | 2 | 5 | 9 | 18 | 36 | 61 | 81 | 101 | 119 | 142 | 574 |
| 2.50 | 255 | — | — | 3 | 5 | 10 | 20 | 40 | 65 | 88 | 113 | 135 | 160 | 639 |

TABLE 2-continued

| N | K | Number of Light Emissions E | | | | | | | | | | | | Total |
|---|---|---|---|---|---|---|---|---|---|---|---|---|---|---|
| 2.75 | 255 | — | — | 3 | 6 | 11 | 22 | 44 | 69 | 96 | 121 | 151 | 179 | 702 |
| 3.00 | 255 | — | — | 3 | 6 | 12 | 24 | 48 | 75 | 102 | 132 | 165 | 198 | 765 |

TABLE 3

| N | K | Difference in Number of Light Emissions | | | | | | | | | | | |
|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 |
| 1.00 | 255 | — | 0 | 2 | 1 | 2 | 2 | 5 | 7 | 9 | 11 | 12 | 15 |
| | | | SF1 | SF2 | SF3 | SF4 | SF5 | SF6 | SF7 | SF8 | SF9 | SF10 | SF11 |
| 1.25 | 255 | — | 1 | 0 | 0 | −1 | 0 | 3 | 8 | 9 | 12 | 16 | 18 |
| 1.50 | 255 | — | 0 | −1 | −1 | 0 | 1 | 3 | 8 | 10 | 12 | 14 | 16 |
| 1.75 | 255 | — | 0 | 0 | −2 | −1 | 0 | 2 | 7 | 9 | 13 | 15 | 19 |
| 2.00 | 255 | — | — | 0 | 3 | 1 | 2 | 4 | 5 | 9 | 11 | 13 | 18 |
| | | | | SF1 | SF2 | SF3 | SF4 | SF5 | SF6 | SF7 | SF8 | SF9 | SF10 |
| 2.25 | 255 | — | — | 1 | 0 | 1 | 2 | 4 | 4 | 7 | 12 | 16 | 18 |
| 2.50 | 255 | — | — | 0 | 1 | 1 | 2 | 4 | 4 | 8 | 8 | 16 | 19 |
| 2.75 | 255 | — | — | 0 | 0 | 1 | 2 | 4 | 6 | 6 | 11 | 14 | 19 |
| 3.00 | 255 | — | — | — | — | — | — | — | — | — | — | — | — |

TABLE 4

| N | K | Percentage of the Difference | | | | | | | | | | | |
|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 |
| 1.00 | 255 | — | 0.0 | 0.8 | 0.4 | 0.8 | 0.8 | 2.0 | 2.7 | 3.5 | 4.3 | 4.7 | 5.9 |
| | | | SF1 | SF2 | SF3 | SF4 | SF5 | SF6 | SF7 | SF8 | SF9 | SF10 | SF11 |
| 1.25 | 255 | — | 0.3 | 0.0 | 0.0 | −0.3 | 0.0 | 0.9 | 2.5 | 2.8 | 3.8 | 5.0 | 5.6 |
| 1.50 | 255 | — | 0.0 | −0.3 | −0.3 | 0.0 | 0.3 | 0.8 | 2.1 | 2.6 | 3.1 | 3.6 | 4.1 |
| 1.75 | 255 | — | 0.0 | 0.0 | −0.4 | −0.2 | 0.0 | 0.4 | 1.6 | 2.0 | 2.9 | 3.3 | 4.2 |
| 2.00 | 255 | — | — | 0.0 | 0.6 | 0.2 | 0.4 | 0.8 | 1.0 | 1.8 | 2.2 | 2.5 | 3.5 |
| | | | | SF1 | SF2 | SF3 | SF4 | SF5 | SF6 | SF7 | SF8 | SF9 | SF10 |
| 2.25 | 255 | — | — | 0.2 | 0.0 | 0.2 | 0.3 | 0.7 | 0.7 | 1.2 | 2.1 | 2.8 | 3.1 |
| 2.50 | 255 | — | — | 0.0 | 0.2 | 0.2 | 0.3 | 0.6 | 0.6 | 1.3 | 1.3 | 2.5 | 3.0 |
| 2.75 | 255 | — | — | 0.0 | 0.0 | 0.1 | 0.3 | 0.6 | 0.9 | 0.9 | 1.6 | 2.0 | 2.7 |
| 3.00 | 255 | — | — | — | — | — | — | — | — | — | — | — | — |

The way to read these tables is as follows. For example, for a 1.00-times mode, subfields range from SF1 through SF12, and the weighting values of subfields SF1 through SF12 are 1, 1, 1, 4, 8, 13, 19, 26, 35, 42, 49, 56, respectively. The total of adding up all these weighting values is 255, and represents the maximum luminance level. Furthermore, the gradation display point number K for Table 1-Table 4 is 256, from 0 to 255, in all cases.

For a 1.00-times mode, only subfield SF1 is selected when producing a level 1 brightness. When producing a level 2 brightness, subfields SF1, SF2 are selected. When producing a level 3 brightness, subfields SF1, SF2, SF3 are selected. When producing a level 4 brightness, only subfield SF4 is selected. By combining subfields in this way, brightness can be changed in minute stages from level 1 through level 255.

For the next stage 1.25-times mode, subfields range from SF1 through SF11, and the weighting values of subfields SF1 through SF11 are 1, 2, 4, 8, 12, 19, 26, 35, 42, 49, 57, respectively. The total of adding up all these is 255. In Table 1-Table 4, the last subfield, which has the largest weighting value, is positioned so as to be at the right edge. Therefore, for example, a 1.00-times mode subfield SF12 weighted "56" is adjacent to a 1.25-times mode subfield SF11 weighted "57."

By doing the same below, the weighting value of subfields SF1 through SF11 for a 1.50-times mode, 1.75-times mode, 2.00-times mode, respectively, is determined so that the overall total works out to 255.

Furthermore, the weighting value of subfields SF1 through SF10 for a 2.25-times mode, 2.50-times mode, 2.75-times mode, 3.00-times mode, respectively, is determined so that the overall total works out to 255.

Table 2 is read as follows. For a 1.00-times mode, the respective number of light emissions of subfields SF1 through SF12 is set using a value, which multiplies by 1 the weighting value indicated by the 1.00-times mode of Table 1. For a 1.25-times mode, the respective number of light emissions of subfields SF1 through SF11 is a value, which multiplies by 1.25 the weighting value indicated by the 1.25-times mode of Table 1, and is set as a rounded-off integer value. A fraction can also be omitted, carried over, or a combination thereof, without rounding to the nearest whole number. This holds true for other multiplier modes as well. Needless to say, a fraction is done away with like this because the number of light emissions of a plasma discharge cannot be controlled using a fractional value. Even when each subfield uses a rounded-off integer value, when a number of light emissions are added together by combining a plurality of subfields, it works out to roughly a 1.25-times number of light emissions. For example, if the number of light emissions from subfields SF1 through SF11 are added together, it makes 320, and this value is close to 318.75, which is 1.25-times 255.

With regard to a 1.50-times mode, too, the respective number of light emissions of subfields SF1 through SF11 is a value, which multiplies by 1.50 the weighting value indicated by the 1.50-times mode of Table 1, and is set as a rounded-off integer value. The number of light emissions is also set for other modes in the same way.

Table 3 is read as follows. A value arrived at by subtracting the number of light emissions in the 1.00-times mode row indicated in Table 2 from a value, which is the number of light emissions of the multiplier mode of the next row (that is, the 1.25-times mode), and which is in an adjacent location, is indicated in the 1.00-times mode row of Table 3. For example, the value "15" arrived at by subtracting "56," the number of light emissions of 1.00-times mode subfield SF12 of Table 2, from "71," the number of light emissions of 1.25-times mode subfield SF11 of Table 2, is indicated in 1.00-times mode subfield SF12 of Table 3 as the difference of the number of light emissions. In other words, Table 3 shows differences in the number of light emissions between adjacent two cells (up and down) in Table 2.

Table 4 is read as follows. The percentage of the difference of the number of light emissions indicated in Table 3 relative to the number of light emissions indicated in Table 2 is listed in Table 4. For example, "15," the difference of the number of light emissions indicated in 1.00-times mode subfield SF12 in Table 3, works out to 5.9% of "255," the total number of light emissions of all 1.00-times mode subfields in Table 2, and this value is listed in 1.00-times mode subfield SF 12 of Table 4. All values in Table 4 are under 6%. In other words, the number of light emissions of Table 2 and the weighting of Table 1 are set so as to work out to less than 6% in Table 4.

Thus, because the difference between adjacent multiplier modes, and the difference of the number of light emissions between subfields, which are lined up in order from those with the largest weighting values, are reduced to less that 6%, since there is no great change in the number of light emissions of each subfield, brightness can be changed smoothly when moving from a certain image to a next image, even if the multiplier mode changes.

Further, with a method known for some time, due to a multiplier mode change being changed by an integer value, when adjacent multiplier modes change, for example, when a 1-times mode and a 2-times mode change, a fixed multiplication factor changes dramatically from 1 to ½, and when a 2-times mode and a 3-times mode change, for example, a fixed multiplication factor changes dramatically from 1 to ⅔. Consequently, the amplitude of a picture signal changes greatly. Thus, when an image signal with a greatly changed picture amplitude is assigned to a subfield and displayed, an image exhibits practically the same brightness around the borders of a multiplier mode, but a subfield, which is to display a light emission, undergoes great change. That is, even if an image exhibits practically the same brightness, a temporal light emission location changes greatly within 1 field time because the temporal location of a subfield, which is to emit light, and a light emission weight change greatly. When an image like this is observed, there is a noticeable change in screen luminance because a temporal light emission location changes within 1 field time.

However, with the present invention, since it is possible to set a fractional multiplier as a multiplier mode, changes in a temporal location of a subfield which is to emit light, and changes in light emission weight can be reduced even when a multiplier mode changes, and the change in luminance observed when a multiplier mode changes can be made extremely small.

Further, when a PDP panel is driven only by a multiplier mode with an integer multiplier, as a result of the saturation phenomenon of the fluorescent material, the brightness between the 1-times mode, 2-times mode, 3-times mode is not the same even when the total number of light emissions is the same. With regard to this kind of problem as well, since the present invention is designed so as to enable a fractional multiplier to be set as the multiplier mode, and since the number of light emissions of a subfield between adjacent multiplier modes is similar, practically the same brightness can be rendered. The present invention, which enables a multiplier mode to be set using a decimal fraction numerical value, can raise the brightness of an image for an image with a small average level of brightness, while smoothly changing brightness, and enables the reproduction of a beautiful image with a sufficient contrast sensation, on a par with a CRT or the like.

First Embodiment

Figure 9:
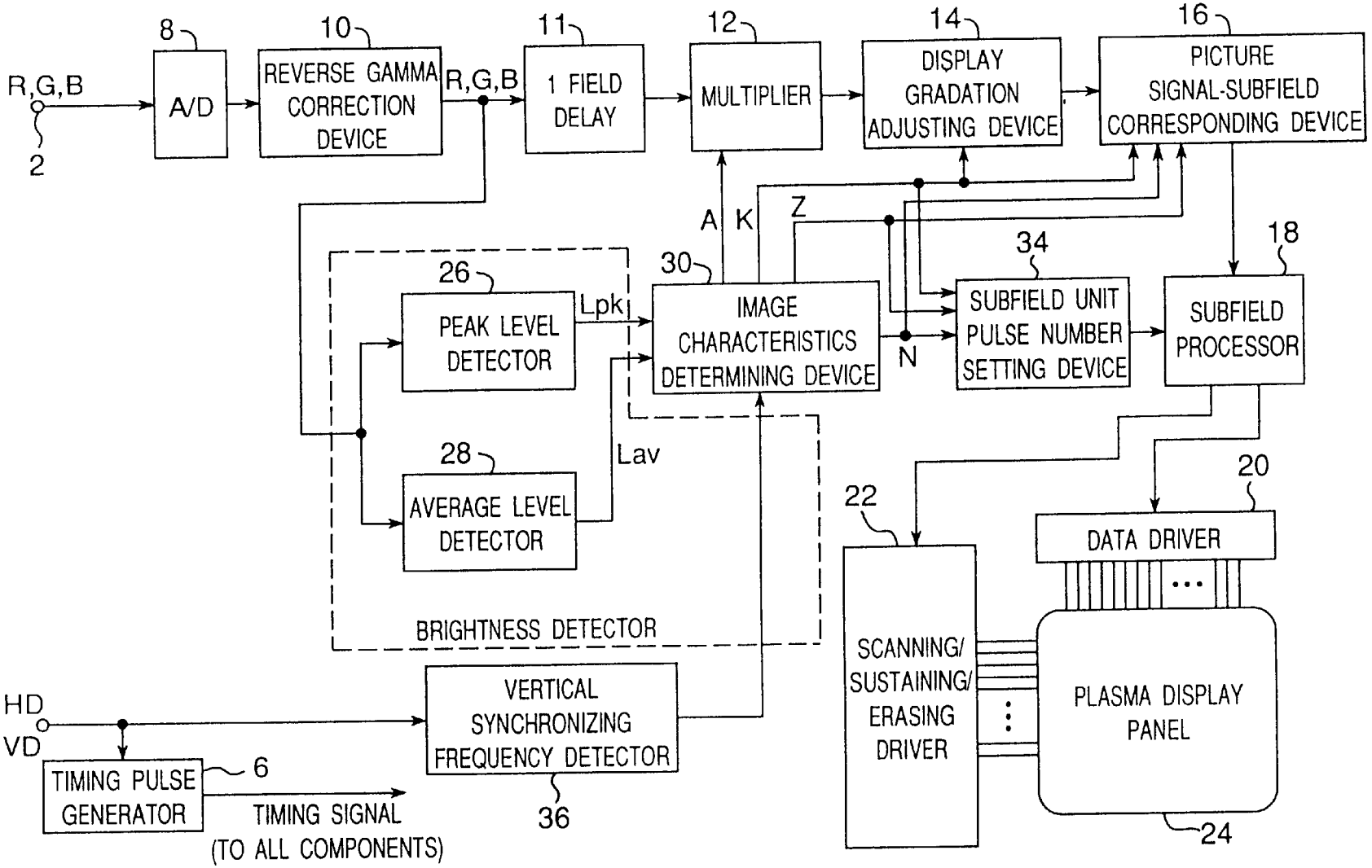
FIG. 9 shows a block diagram of a display apparatus of a first embodiment.

FIG. 9 shows a block diagram of a display apparatus of a first embodiment. Input 2 receives R, G, B signals. A vertical synchronizing signal, horizontal synchronizing signal are inputted to a timing pulse generator 6 from input terminals VD, HD, respectively. An A/D converter 8 receives R, G, B signals and performs A/D conversion. A/D converted R, G, B signals undergo reverse gamma correction via a reverse gamma-correcting device 10. Prior to reverse gamma correction, the level of each of the R, G, B signals, from a minimum 0 to a maximum 255, is represented one-by-one in accordance with an 8-bit signal as 256 linearly different levels (0, 1, 2, 3, 4, 5, . . . 255). Following reverse gamma correction, the levels of the R, G, B signals, from a minimum 0 to a maximum 255, are each displayed with an accuracy of roughly 0.004 in accordance with a 16-bit signal as 256 non-linearly different levels.

Post-reverse gamma correction R, G, B signals are sent to a 1 field delay 11, and are also sent to a peak level detector 26 and an average level detector 28. A 1 field delayed signal from the 1 field delay 11 is applied to a multiplier 12.

With the peak level detector 26, an R signal peak level Rmax, a G signal peak level Gmax, and a B signal peak level Bmax are detected in data of 1 field, and the peak level Lpk of the Rmax, Gmax and Bmax is also detected. That is, with the peak level detector 26, the brightest value in 1 field is detected. With the average level detector 28, an R signal average value Rav, a G signal average value Gav, and a B signal average value Bav are sought in data of 1 field, and the average level Lav of the Rav, Gav and Bav is also determined. That is, with the average level detector 28, the average value of the brightness in 1 field is determined.

An image characteristic determining device 30 receives the average level Lav and peak level Lpk, and decides 4 parameters: N-times mode value N; fixed multiplication factor A of a multiplier 12; subfield number Z; and gradation display point number K, by combining the average level and peak level.

Figure 10:
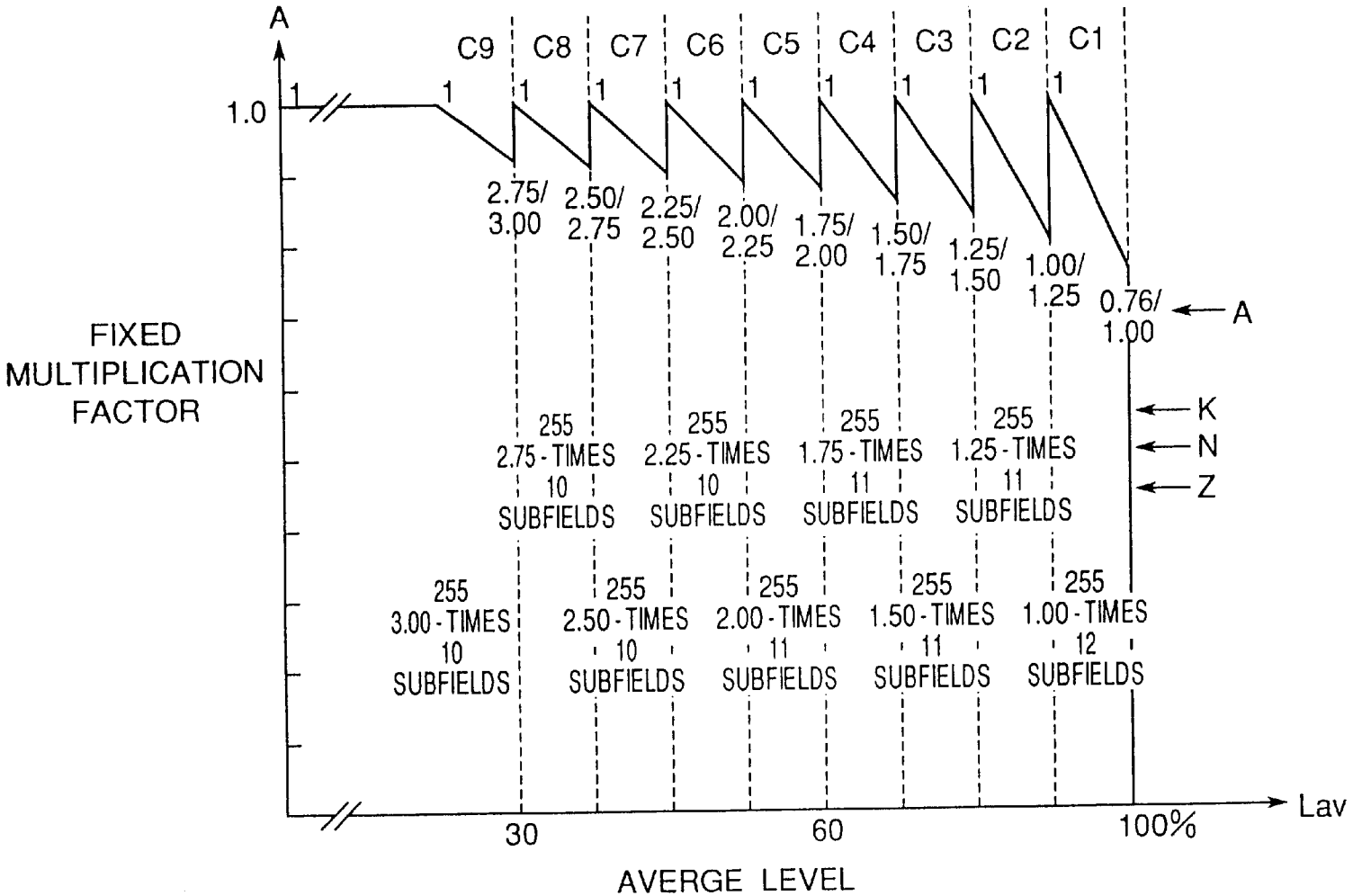
FIG. 10 shows an expansion diagram of a parameter-determining map used in the first embodiment.

FIG. 10 is a map for determining parameters used in the first embodiment, and is utilized by the image characteristic-determining device 30. Since a peak level signal is not used when utilizing the parameter-determining map of FIG. 10, the peak level detector 26 can be omitted.

The map of FIG. 10 represents the average level Lav along the horizontal axis, and represents the fixed multiplication factor A along the vertical axis. The map of FIG. 10 is divided by lines parallel to the vertical axis into a plurality of columns, in the example of FIG. 10, into 9 columns C1, C2, C3, C4, C5, C6 C7, C8, C9 at a roughly 10% pitch from the upper level. The above-mentioned 4 parameters: N-times mode value N; fixed multiplication factor A of a multiplier 12; subfield number Z; and gradation display point number K, are specified for each column. The numerical values of the 4 parameters are represented in the same manner in maps shown in other figures.

As shown in FIG. 10, the column C1 setting is fixed at subfield number 12, 1.00-times mode, 225 gradation display points, and the fixed multiplication factor changes from 1 to 0.76/1.00 from the left edge to the right edge. The column C2 setting is fixed at subfield number 11, 1.25-times mode, 225 gradation display points, and the fixed multiplication factor changes from 1 to 1.00/1.25 from the left edge to the right edge. The settings in the other columns are also as shown in FIG. 10.

As is clear from the map in FIG. 10, each time the average level Lav drops, and the column changes, the subfield number Z either remains the same or decreases, and the weighting multiplier N increases at a 0.25 pitch. Further, the fixed multiplication factor A changes continuously in each column from a value less than 1 to 1 from the right edge to the left edge. And the fixed multiplication factor A is set so as to become a value equivalent to the results of multiplying the fixed multiplication factor A and the weighting multiplier N, that is, equivalent to the number of light emissions before and after the border of each column.

When utilizing the map of FIG. 10, for example, when a certain image i changes to the next image i+1, if it is assumed that the rendering of image i is controlled by the parameters of column C1, and the rendering of image i+1 is controlled by the parameters of column C2, since the PDP driving signal changes from a 1.00-times mode to a 1.25-times mode, image brightness changes in minute gradations. To correct this gradational change of brightness, fixed multiplication factor A is changed. In the above example, if it is assumed that the rendition of image i was performed in the vicinity of the left edge of column C1, since brightness is proportional to N×A, it would be proportional to 1×1=1. Further, if it is assumed that the rendition of image i+1 is performed in the vicinity of the right edge of column C2, since brightness is proportional to N×A, it would be proportional to 1.25×1.00/1.25=1. Therefore, both image i and image i+1 are driven at a 1-times brightness, and the gradational change of brightness disappears. Further, when the average level of an image is changing in the direction of becoming brighter, for example, when it is changing from the right edge to the left edge within column C2, PDP drive is performed using a 1.25-times mode, but because the fixed multiplication factor A changes continuously from 1.00/1.25 to 1, the brightness also changes continuously from 1-times (1.25×1.25) to 1.25-times (1.25×1). In this way, when the average level decreases, the brightness in column C9 also changes continuously from 2.75-times (3.00×2.75/3.00) to 3.00 times (3.00×1).

In the example shown in FIG. 10, the columns are divided at a roughly 10% pitch, but they can also be divided more minutely. For example, if it is assumed that columns are-divided at a 1% pitch, column C1 of FIG. 10 would be divided further into 10 portions, from column $C1_1$ to $C1_{10}$ (not shown in figure). The weighting multiplier N would increase at a 0.025 pitch, 1.000 in column $C1_1$, 1.025 in column $C1_2$, 1.050 in column $C1_3$, and the fixed multiplication factor A would change, for example, from 1.000/1.025 to 1 from right to left in column $C1_2$, and would change from 1.025/1.050 to 1 in column $C1_3$. Thus, since fixed multiplication factor A becomes an extremely small change, it is possible to use 1 as a fixed value without changing. That is, by dividing the columns minutely, it becomes possible to continuously change brightness across an entire average level range without changing the fixed multiplication factor A, by minutely setting the weighting multiplier for each column using a fractional value.

The image characteristic determining device 30 receives an average level Lav as described above, and utilizes a previously stored map (FIG. 10) to specify the 4 parameters N, A, Z, K. In addition to using a map, the 4 parameters can also be specified via calculation and computer processing.

A multiplier 12 receives a fixed multiplication factor A, and multiplies the respective R, G, B signals A times. In accordance with this, the entire screen becomes A-times brighter. Furthermore, the multiplier 12 receives a 16-bit signal, which is expressed out to the third decimal place for the respective R, G, B signals, and after using a prescribed operation to perform a carry from a decimal place, the multiplier 12 once again outputs a 16-bit signal.

A display gradation adjusting device 14 receives a gradation display point number K. The display gradation adjusting device 14 changes the brightness signal (16-bit), which is expressed in detail out to the third decimal place, to the nearest gradation display point (8-bit). For example, assume the value outputted from the multiplier 12 is 153.125. As an example, if the gradation display point number K is 128, since a gradation display point can only take an even number, it changes 153.125 to 154, which is the nearest gradation display point. As another example, if the gradation display point number K is 64, since a gradation display point can only take a multiplier of 4, it changes 153.125 to 152 (=4×38), which is the nearest gradation display point. In this manner, the 16-bit signal received by the display gradation adjusting device 14 is changed to the nearest gradation display point on the basis of the value of a gradation display point number K, and this 16-bit signal is outputted as an 8-bit signal.

A picture signal-subfield corresponding device 16 receives a subfield number Z, a gradation display point number K, and a weighting multiplier N, and changes the 8-bit signal sent from the display gradation adjusting device 14 to a Z-bit signal. The picture signal-subfield corresponding device 16 stores Table 1, and sets the subfield combination which will enable the desired gradation to be output. For example, assume that gradation 6 has been inputted as the desired gradation. When 6 is expressed as a standard binary numeral, it becomes (0000 0110). If a PDP driving signal is standard form, subfields SF2, SF3 are used therefor. However, for the 1.00-times mode PDP driving signal shown in Table 1, subfields SF1, SF2, SF4 (or SF2, SF3, SF4, or SF1, SF3, SF4, are also possible) are utilized to express gradation 6. Further, for the 1.25-times mode PDP driving signal shown in Table 1, subfields SF2, SF3 are utilized to represent gradation 6, and for a 1.50-times mode, subfield SF 4 only (or SF1, SF2, SF3 are also possible) is utilized. In addition to Table 1, a comparison table (table listing all gradations for a multiplier N, and the subfield combinations relative thereto), which shows what combinations of subfields generate a desired gradation based on the multiplier mode set in the image characteristic determining device 30, is also stored in the picture signal-subfield corresponding device 16.

A subfield processor 18 receives data from a subfield unit pulse number setting device 34, and decides the number of sustaining pulses put out during sustain period P3. Table 2 is stored, and a sustaining pulse that accords with a number of light emissions is set in the subfield unit pulse number setting device 34. The subfield unit pulse number setting device 34 receives from an image characteristic determining device 30 an N-times mode value N, a subfield number Z, and a gradation display point number K, and specifies a number of sustaining pulses required for each subfield.

Pulse signals required for setup period P1, write period P2 and sustain period P3 are applied from the subfield processor 18, and a PDP driving signal is outputted. The PDP driving signal is applied to a data driver 20, and a scanning/holding/erasing driver 22, and a display is performed on a plasma display panel 24.

Details concerning the display gradation adjusting device 14, picture signal-subfield corresponding device 16, subfield unit pulse number setting device 6, and subfield processor 18 are disclosed in the specification of patent application no. (1998)-271030 (Title: Display Apparatus Capable of Adjusting Subfield Number in Accordance with Brightness) submitted on the same date as this application by the same applicant and the same inventor.

As explained above, since 4 parameters: N-times mode value N; fixed multiplication factor A of a multiplier 12; subfield number Z; and gradation display point number K, can be decided by the average level Lav of 1 field, and brightness can be changed continuously, there is no sense of incongruousness even when brightness changes.

Figure 13:
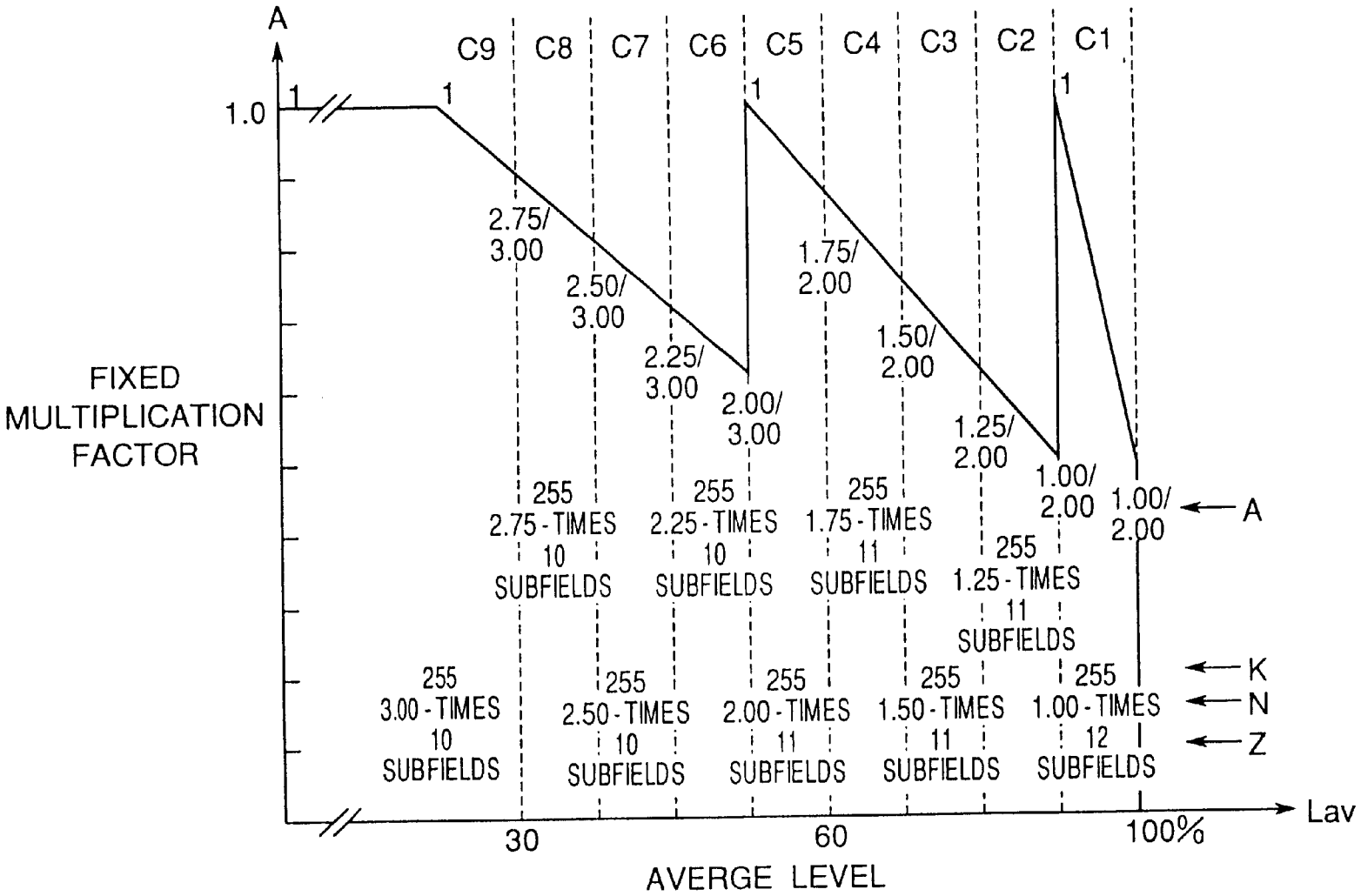
FIG. 13 shows a variation of the parameter-determining map used in the first embodiment.

FIG. 13 is a variation of the parameter-determining map shown in FIG. 10. FIG. 10 is a map developed in accordance with Table 1, Table 2, Table 3, Table 4, and FIG. 13 is a map developed in accordance with Table 5, Table 6, Table 7, Table 8, which are explained below. In FIG. 10, the fixed multiplication factor A changes from a certain fractional value to 1 in each column, but in the variation of FIG. 13, the fixed multiplication factor A changes from a certain fractional value to 1 across a plurality of columns. By so doing, it is possible to decrease the data quantity of the fixed multiplication factor A.

Second Embodiment

Figure 11:
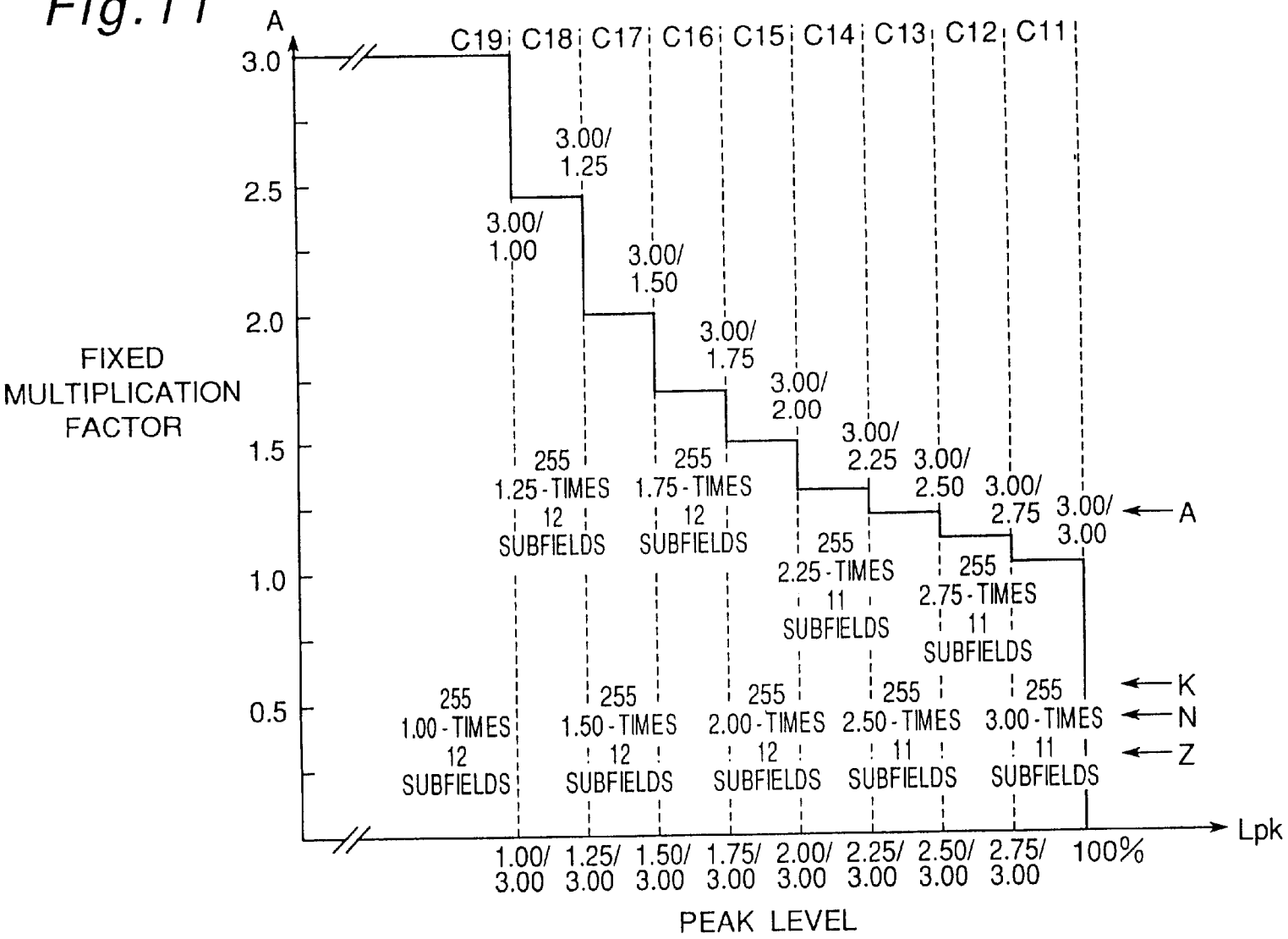
FIG. 11 shows an expansion diagram of a parameter-determining map used in a second embodiment.

FIG. 11 is a parameter-determining map utilized in a second embodiment, and is utilized by the image characteristic determining device 30 in the block diagram shown in FIG. 9. When the parameter-determining map of FIG. 11 is utilized, since the average level signal Lav is not used, the average level detector 28 in the block diagram of FIG. 9 can be omitted.

The map of FIG. 11 represents the peak level along the horizontal axis, and the fixed multiplication factor A along the vertical axis. The map of FIG. 11 is divided into a plurality of columns, in the example of FIG. 11, from an upper level to 2.75/3.00 is C11, from there to 2.50/3.00 is C12, from there to 2.25/3.00 is C13, from there to 2.00/3.00 is C14, from there to 1.75/3.00 is C15, from there to 1.50/3.00 is C16, from there to 1.25/3.00 is C17, from there to 1.00/3.00 is C18, and therebelow is C19, by lines that parallel the vertical axis. The above-mentioned 4 parameters: N-times mode value N; fixed multiplication factor A of a multiplier 12; subfield number Z; and gradation display point number K, are specified for each column.

As shown in FIG. 11, the column C11 setting is subfield number 11, 3.00-times mode, gradation display point number 225, fixed multiplication factor 3.00/3.00. The column C12 setting is subfield number 11, 2.75-times mode, gradation display point number 225, fixed multiplication factor 3.00/2.75. Settings for the other columns are as shown in FIG. 11.

As is clear from FIG. 11, each time the peak level Lpk drops, and the column changes, the subfield number Z either remains the same or increases, and the weighting multiplier N decreases at a 0.25 pitch. Further, the fixed multiplication factor A is set so as to become a value equivalent to the results of multiplying the fixed multiplication factor A and the weighting multiplier N, that is, equivalent to the number of light emissions, before and after the border of each column. By changes in peak level, even if an image displayed by data of a certain column changes to an image displayed by data of another column, a gradational change of brightness does not occur.

When the peak level Lpk for the second embodiment is large, by increasing a weighting multiplier N, and increasing the brightness of the entire screen, it is possible to further intensify peak level light. Further, when the peak level Lpk is small, decreasing a weighting multiplier N, and standardizing the brightness of the entire screen serve to prevent extra intensification.

When the peak level of brightness is low, the gradation number assigned to an overall image decreases. In accordance with the present invention, since the fixed multiplication factor A is increased, and the weighting multiplier N is decreased, the gradation number assigned to an overall image can be increased. However, when adjacent multiplier modes change, for example, when a 1-times mode and a 2-times mode change, a fixed multiplication factor changes dramatically from 1 to ½, and when a 2-times mode and a 3-times mode change, for example, a fixed multiplication factor changes dramatically from 1 to ⅔. Consequently, the amplitude of a picture signal changes greatly. Thus, when an image signal with a greatly changed picture amplitude is assigned to a subfield and displayed, an image exhibits practically the same brightness around the borders of a multiplier mode, but a subfield, which is to display a light emission, undergoes great change. That is, even if an image exhibits practically the same brightness, a temporal light emission location changes greatly within 1 field time because the temporal location of a subfield, which is to emit light, and a light emission weight change greatly. When an image like this is observed, there is a noticeable change in screen luminance because a temporal light emission location changes within 1 field time.

However, with the present invention, since it is possible to set a fractional multiplier as a multiplier mode, changes in a temporal location of a subfield which is to emit light, and changes in light emission weight can be reduced even when a multiplier mode changes, and the change in luminance observed when a multiplier mode changes can be made extremely small.

Further, when a PDP panel is driven only by a multiplier mode with an integer multiplier, as a result of the saturation phenomenon of the fluorescent material, the brightness between the 1-times mode, 2-times mode, 3-times mode is not the same even when the total number of light emissions is the same. With regard to this kind of problem as well, since the present invention is designed so as to enable a fractional multiplier to be set as the multiplier mode, and since the number of light emissions of a subfield between adjacent multiplier modes is similar, practically the same brightness can be rendered. Moreover, even for an overall dark image, for which peak luminance is low, since sufficient gradations can be applied to an overall image, it is possible to reproduce a beautiful image. The present invention, which enables a multiplier mode to be set using a decimal fraction numerical value, is extremely useful from a practical standpoint.

Figure 14:
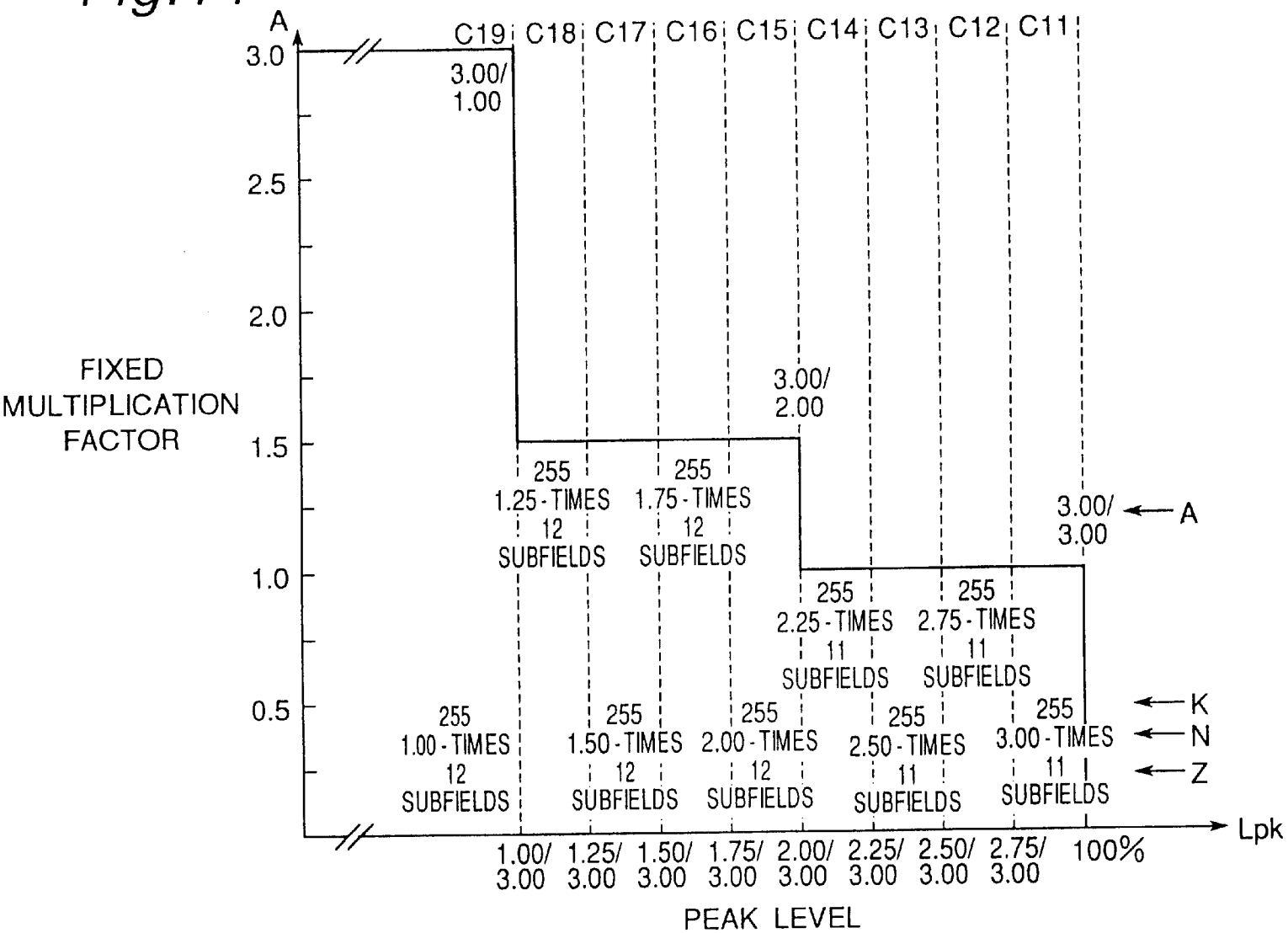
FIG. 14 shows a variation of the parameter-determining map used in the second embodiment.

FIG. 14 is a variation of the parameter-determining map shown in FIG. 11. FIG. 11 is a map developed in accordance with Table 1, Table 2, Table 3, Table 4, and FIG. 14 is a map developed in accordance with Table 5, Table 6, Table 7, Table 8, which are explained below. In FIG. 11, a fixed multiplication factor A is set for each column, but in the variation of FIG. 14, a fixed multiplication factor A is set across a plurality of columns. By so doing, it is possible to decrease the data quantity of the fixed multiplication factor A.

Third Embodiment

Figure 12:
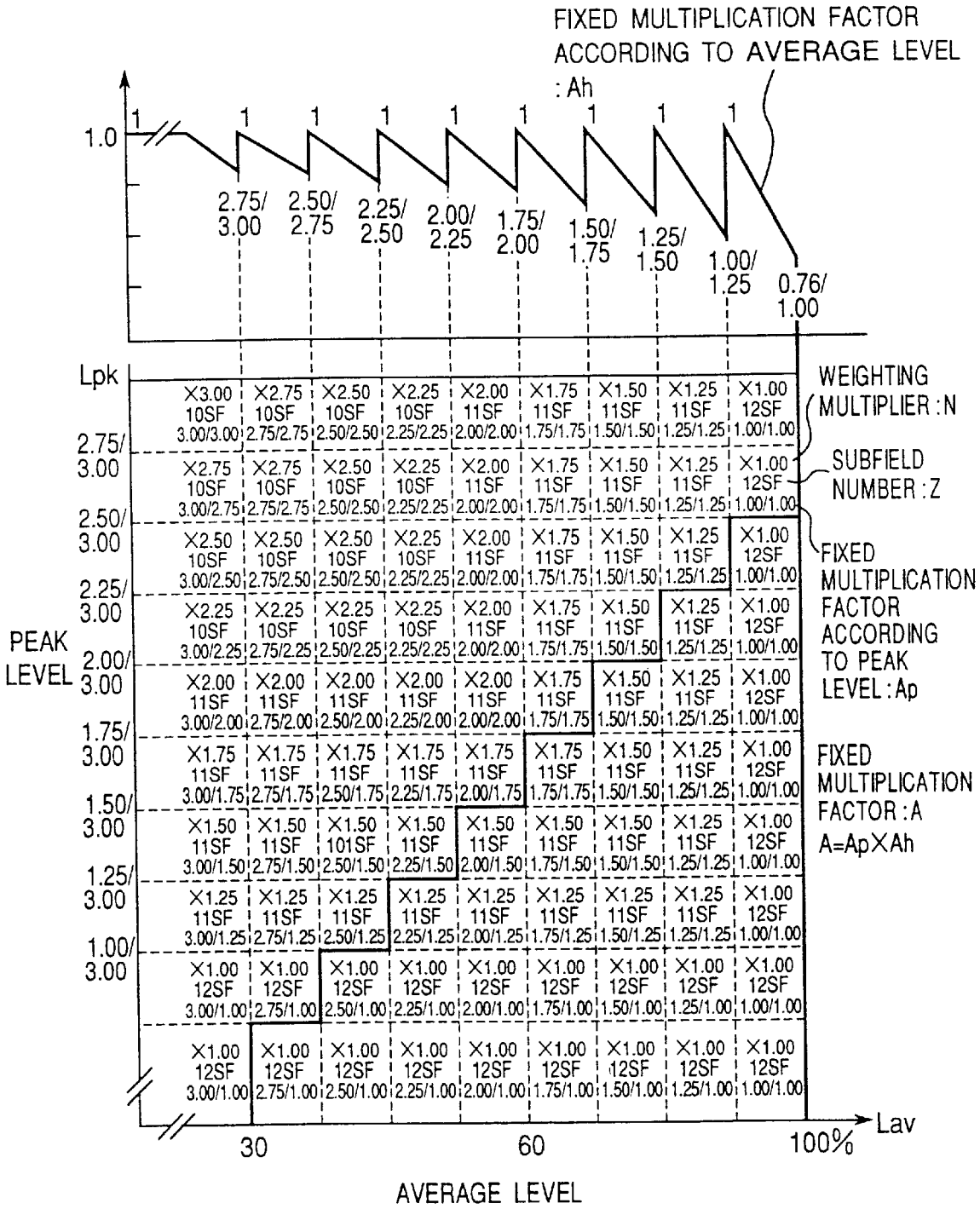
FIG. 12 shows an expansion diagram of a parameter-determining map used in a third embodiment.

FIG. 12 is a parameter-determining map utilized in a third embodiment, and is utilized by the image characteristic determining device 30 in the block diagram shown in FIG. 9. When the parameter-determining map of FIG. 13 is utilized, since both an average level signal Lav and a peak level signal Lpk are used, both the average level detector 28 and the peak level detector 26 in the block diagram of FIG. 9 are utilized. The third embodiment is a combination of the first and second embodiments.

The map of FIG. 12 represents the average level Lav along the horizontal axis, and the peak level along the vertical axis. The map of FIG. 12 is divided into a plurality of columns by lines that parallel the vertical axis, and into a plurality of rows by lines that parallel the horizontal axis. In the example of FIG. 12, the map is divided along the horizontal axis into 9 columns at a roughly 10% pitch from a higher level, and is divided into 10 rows along the vertical axis at a 0.25 pitch from a higher level. Therefore, a total of 90 segments can be created. The values of the above-mentioned 4 parameters: N-times mode value N; fixed multiplication factor Ap according to a peak level; subfield number Z; and gradation display point number K, are specified for each segment. Further, a fixed multiplication factor Ah is specified according to an average level for each column. The final fixed multiplication factor A is determined by Ap×Ah.

As shown in FIG. 12, the setting in the segment of the upper left corner is subfield number 10, 3.00-times mode, fixed multiplication factor 3.00/3.00 according to a peak. The gradation display point number K is not shown in FIG. 12, but is 225 for all segments. The setting in the segment right-adjacent to the upper left corner is subfield number 10, 2.75-times mode, fixed multiplication factor 2.75/2.75 according to a peak. Settings for the other segments are as shown in FIG. 12.

As is clear from FIG. 12, each time a peak level Lpk drops, and a row changes, the subfield number Z either remains the same or increases, and the weighting multiplier N decreases at a 0.25 pitch. Further, each time an average level Lav drops, and a column changes, the subfield number Z either remains the same or decreases, and the weighting multiplier N increases at a 0.25 pitch. Furthermore, a fixed multiplication factor A is set so as to become a value equivalent to the results of multiplying a weighting multiplier N and a fixed multiplication factor A, which is the product of a fixed multiplication factor Ap according to a peak level, and a fixed multiplication factor Ah according to an average level, that is, equivalent to the number of light emissions, before and after the border of each segment. By changes in peak level and changes in average level, even if an image displayed by data of a certain segment changes to an image displayed by data of another segment, a gradational change of brightness does not occur.

For this third embodiment, since it is a combination of the first embodiment and the second embodiment, change in luminance is slight, even if the average level of brightness changes and migrates to an adjacent multiplier mode. It can raise image brightness for an image with a small average level of brightness, while smoothly changing brightness, and enables the reproduction of a beautiful image with sufficient contrast sensation, on a par with a CRT or the like. Further, since sufficient gradations can be applied to an entire image, a beautiful image can be reproduced even for an overall dark image, with low peak luminance.

Figure 15:
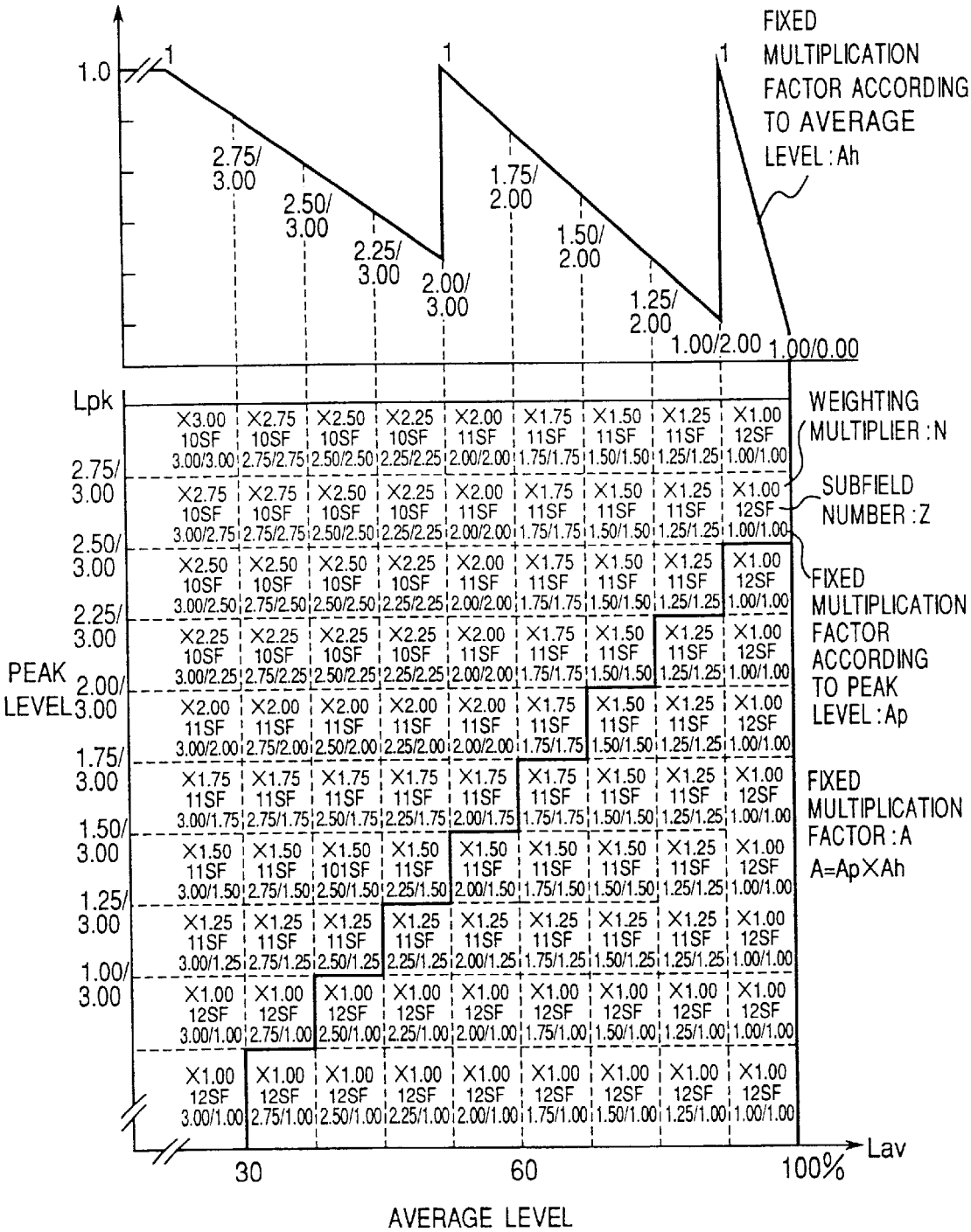
FIG. 15 shows a variation of the parameter-determining map used in the third embodiment.

FIG. 15 is a variation of the parameter-determining map shown in FIG. 12. FIG. 12 is a map developed in accordance with Table 1, Table 2, Table 3, Table 4, and FIG. 15 is a map developed in accordance with Table 5, Table 6, Table 7, Table 8, which are explained below. In FIG. 12, a fixed multiplication factor A according to an average level changes from a certain fractional value to 1 in each column, but in the variation of FIG. 15, a fixed multiplication factor A according to an average level changes from a certain fractional value to 1 across a plurality of columns.

By so doing, it is possible to decrease the data quantity of fixed multiplication factor A.

Variation of Table 1, Table 2, Table 3, Table 4

Table 5, Table 6, Table 7, Table 8 shown below depict variations of Table 1, Table 2, Table 3, Table 4, respectively.

TABLE 5

| N | K | Weighting value Q | | | | | | | | | | | | Total |
|---|---|---|---|---|---|---|---|---|---|---|---|---|---|---|
| | | SF1 | SF2 | SF3 | SF4 | SF5 | SF6 | SF7 | SF8 | SF9 | SF10 | SF11 | SF12 | |
| 1.00 | 255 | 1 | 2 | 4 | 6 | 10 | 14 | 19 | 25 | 32 | 40 | 48 | 54 | 255 |
| | | | SF1 | SF2 | SF3 | SF4 | SF5 | SF6 | SF7 | SF8 | SF9 | SF10 | SF11 | |
| 1.25 | 159 | 0 | 1 | 2 | 4 | 6 | 9 | 12 | 15 | 21 | 26 | 30 | 33 | 159 |
| 1.50 | 191 | — | 1 | 2 | 4 | 6 | 7 | 14 | 20 | 27 | 32 | 37 | 41 | 191 |
| 1.75 | 223 | — | 1 | 1 | 3 | 4 | 8 | 15 | 25 | 32 | 38 | 45 | 51 | 223 |

TABLE 5-continued

| N | K | | | | | | | | | | | | | Total |
|---|---|---|---|---|---|---|---|---|---|---|---|---|---|---|
| | | | | Weighting value Q | | | | | | | | | | |
| 2.00 | 255 | — | 1 | 2 | 3 | 4 | 6 | 15 | 28 | 36 | 45 | 53 | 62 | 255 |
| | | | | SF1 | SF2 | SF3 | SF4 | SF5 | SF6 | SF7 | SF8 | SF9 | SF10 | |
| 2.25 | 191 | — | — | 1 | 2 | 2 | 6 | 12 | 20 | 27 | 34 | 40 | 47 | 191 |
| 2.50 | 213 | — | — | 1 | 2 | 4 | 6 | 13 | 22 | 29 | 38 | 45 | 53 | 213 |
| 2.75 | 234 | — | — | 1 | 2 | 4 | 7 | 15 | 23 | 32 | 40 | 50 | 60 | 234 |
| 3.00 | 255 | — | — | 1 | 2 | 4 | 8 | 16 | 25 | 34 | 44 | 55 | 66 | 255 |

TABLE 6

| N | K | | | | | | | | | | | | | Total |
|---|---|---|---|---|---|---|---|---|---|---|---|---|---|---|
| | | | | Number of Light Emissions | | | | | | | | | | |
| | | SF1 | SF2 | SF3 | SF4 | SF5 | SF6 | SF7 | SF8 | SF9 | SF10 | SF11 | SF12 | |
| 1.00 | 255 | 1 | 2 | 4 | 6 | 10 | 14 | 19 | 25 | 32 | 40 | 48 | 54 | 255 |
| | | | SF1 | SF2 | SF3 | SF4 | SF5 | SF6 | SF7 | SF8 | SF9 | SF10 | SF11 | |
| 1.25 | 159 | — | 2 | 4 | 8 | 12 | 18 | 24 | 30 | 42 | 52 | 60 | 66 | 318 |
| 1.50 | 191 | — | 2 | 4 | 8 | 12 | 14 | 28 | 40 | 54 | 64 | 74 | 82 | 382 |
| 1.75 | 223 | — | 2 | 2 | 6 | 8 | 16 | 30 | 50 | 64 | 76 | 90 | 102 | 446 |
| 2.00 | 255 | — | 2 | 4 | 6 | 8 | 12 | 30 | 56 | 72 | 90 | 106 | 124 | 510 |
| | | | | SF1 | SF2 | SF3 | SF4 | SF5 | SF6 | SF7 | SF8 | SF9 | SF10 | |
| 2.25 | 191 | ’ | — | 3 | 6 | 6 | 18 | 36 | 60 | 81 | 102 | 120 | 141 | 573 |
| 2.50 | 213 | — | — | 3 | 6 | 12 | 18 | 39 | 66 | 87 | 114 | 135 | 159 | 639 |
| 2.75 | 234 | — | — | 3 | 6 | 12 | 21 | 45 | 69 | 96 | 120 | 150 | 180 | 702 |
| 3.00 | 255 | — | — | 3 | 6 | 12 | 24 | 48 | 75 | 102 | 132 | 165 | 198 | 765 |

TABLE 7

| N | K | | | | | | | | | | | | |
|---|---|---|---|---|---|---|---|---|---|---|---|---|---|
| | | | | Difference in Number of Light Emissions | | | | | | | | | |
| | | SF1 | SF2 | SF3 | SF4 | SF5 | SF6 | SF7 | SF8 | SF9 | SF10 | SF11 | SF12 |
| 1.00 | 255 | −1 | 0 | 0 | 2 | 2 | 4 | 5 | 5 | 10 | 12 | 12 | 12 |
| | | | SF1 | SF2 | SF3 | SF4 | SF5 | SF6 | SF7 | SF8 | SF9 | SF10 | SF11 |
| 1.25 | 159 | — | 0 | 0 | 0 | 0 | −4 | 4 | 10 | 12 | 12 | 14 | 16 |
| 1.50 | 191 | — | 0 | −2 | −2 | −4 | 2 | 2 | 10 | 10 | 12 | 16 | 20 |
| 1.75 | 223 | — | 0 | 2 | 0 | 0 | −4 | 0 | 6 | 8 | 14 | 16 | 22 |
| 2.00 | 255 | — | −2 | −1 | 0 | −2 | 6 | 6 | 4 | 9 | 12 | 14 | 17 |
| | | | | SF1 | SF2 | SF3 | SF4 | SF5 | SF6 | SF7 | SF8 | SF9 | SF10 |
| 2.25 | 191 | — | — | 0 | 0 | 6 | 0 | 3 | 6 | 6 | 12 | 15 | 18 |
| 2.50 | 213 | — | — | 0 | 0 | 0 | 3 | 6 | 3 | 9 | 6 | 15 | 21 |
| 2.75 | 234 | — | — | 0 | 0 | 0 | 3 | 3 | 6 | 6 | 12 | 15 | 18 |
| 3.00 | 255 | — | — | — | — | — | — | — | — | — | — | — | — |

TABLE 8

| N | K | | | | | | | | | | | | |
|---|---|---|---|---|---|---|---|---|---|---|---|---|---|
| | | | | Percentage of the Difference | | | | | | | | | |
| | | SF1 | SF2 | SF3 | SF4 | SF5 | SF6 | SF7 | SF8 | SF9 | SF10 | SF11 | SF12 |
| 1.00 | 255 | −0.4 | 0.0 | 0.0 | 0.8 | 0.8 | 1.6 | 2.0 | 2.0 | 3.9 | 4.7 | 4.7 | 4.7 |
| | | | SF1 | SF2 | SF3 | SF4 | SF5 | SF6 | SF7 | SF8 | SF9 | SF10 | SF11 |
| 1.25 | 159 | — | 0.0 | 0.0 | 0.0 | 0.0 | −1.3 | 1.3 | 3.1 | 3.8 | 3.8 | 4.4 | 5.0 |
| 1.50 | 191 | — | 0.0 | −0.5 | −0.5 | −1.0 | 0.5 | 0.5 | 2.6 | 2.6 | 3.1 | 4.2 | 5.2 |
| 1.75 | 223 | — | 0.0 | 0.4 | 0.0 | 0.0 | −0.9 | 0.0 | 1.3 | 1.8 | 3.1 | 3.6 | 4.9 |
| 2.00 | 255 | — | −0.4 | −0.2 | 0.0 | −0.4 | 1.2 | 1.2 | 0.8 | 1.8 | 2.4 | 2.7 | 3.3 |
| | | | | SF1 | SF2 | SF3 | SF4 | SF5 | SF6 | SF7 | SF8 | SF9 | SF10 |

TABLE 8-continued

| N | K | Percentage of the Difference | | | | | | | | | | | |
|---|---|---|---|---|---|---|---|---|---|---|---|---|---|
| 2.25 | 191 | — | — | 0.0 | 0.0 | 1.0 | 0.0 | 0.5 | 1.0 | 1.0 | 2.1 | 2.6 | 3.1 |
| 2.50 | 213 | — | — | 0.0 | 0.0 | 0.0 | 0.5 | 0.9 | 0.5 | 1.4 | 0.9 | 2.3 | 3.3 |
| 2.75 | 234 | — | — | 0.0 | 0.0 | 0.0 | 0.4 | 0.4 | 0.9 | 0.9 | 1.7 | 2.1 | 2.6 |
| 3.00 | 255 | — | — | — | — | — | — | — | — | — | — | — | — |

Table 5 is read as follows. For a 1.00-times mode, subfields range from SF1 to SF12, and the weighting value of subfield SF1 through SF12 is 1, 2, 4, 6, 10, 14, 19, 25, 32, 40, 48, 54, respectively. Adding all these weighting values together totals 255, indicating the maximum luminance level.

For the 1.25-times mode of the next stage, subfields range from SF1 to SF11, and the weighting value of subfield SF1 through SF11 is 1, 2, 4, 6, 9, 12, 15, 21, 26, 30, 33, respectively. Adding all these together totals 159. This value is roughly equivalent to multiplying the maximum luminance level of a 1-times mode, 255, by 1.25, and then dividing by two.

For the 1.50-times mode of the next stage, subfields range from SF1 to SF11, and the weighting value of subfield SF1 through SF11 is 1, 2, 4, 6, 7, 14, 20, 27, 32, 37, 41, respectively. Adding all these together totals 191. This value is roughly equivalent to multiplying the maximum luminance level of a 1-times mode, 255, by 1.50, and then dividing by two.

For the 1.75-times mode of the next stage, subfields range from SF1 to SF11, and adding up all the weighting values of subfield SF1 through SF11 totals 223. This value is roughly equivalent to multiplying the maximum luminance level of a 1-times mode, 255, by 1.75, and then dividing by two.

For the 2.00-times mode of the next stage, subfields range from SF1 to SF11, and adding up all the weighting values of subfield SF1 through SF11 totals 255. This value is equivalent to multiplying the maximum luminance level of a 1-times mode, 255, by 2.00, and then dividing by two.

For the 2.25-times mode of the next stage, subfields range from SF1 to SF10, and adding up all the weighting values of subfield SF1 through SF10 totals 191. This value is roughly equivalent to multiplying the maximum luminance level of a 1-times mode, 255, by 2.25, and then taking ⅓ thereof.

For the 2.50-times mode of the next stage, subfields range from SF1 to SF10, and adding up all the weighting values of subfield SF1 through SF10 totals 213. This value is roughly equivalent to multiplying the maximum luminance level of a 1-times mode, 255, by 2.50, and then taking ⅓ thereof.

For the 2.75-times mode of the next stage, subfields range from SF1 to SF10 and adding up all the weighting values of subfield SF1 through SF10 totals 191. This value is roughly equivalent to multiplying the maximum luminance level of a 1-times mode, 255, by 2.75, and then taking ⅓ thereof.

For the 3.00-times mode of the next stage, subfields range from SF1 to SF10, and adding up all the weighting values of subfield SF1 through SF10 totals 255. This value is equivalent to multiplying the maximum luminance level of a 1-times mode, 255, by 3.00, and then taking ⅓ thereof.

The significance of selecting the above-mentioned numerical values is explain for Table 6.

Similar to Table 1-Table 4, the last subfield, which has the largest weighting value, is also positioned to the extreme right in Table5-Table 8.

Table 6 is read as follows. For a 1.00-times mode, the respective number of light emissions of subfields SF1 through SF12 is set using a value that results from multiplying by 1 the weighting value indicated in the 1.00-times mode of FIG. 5. For a 1.25-times mode, the respective number of light emissions of subfields SF1 through SF11 is set using a value that results from multiplying by 2 the weighting value indicated in the 1.25-times mode of FIG. 5. Similarly, for a 1.50-times mode, a 1.75-times mode, a 2.00-times mode, the respective number of light emissions of subfields SF1 through SF11 is set using a value that results from multiplying by 2 the weighting values indicated in the respective multiplier modes thereof of FIG. 5.

Figure 5:
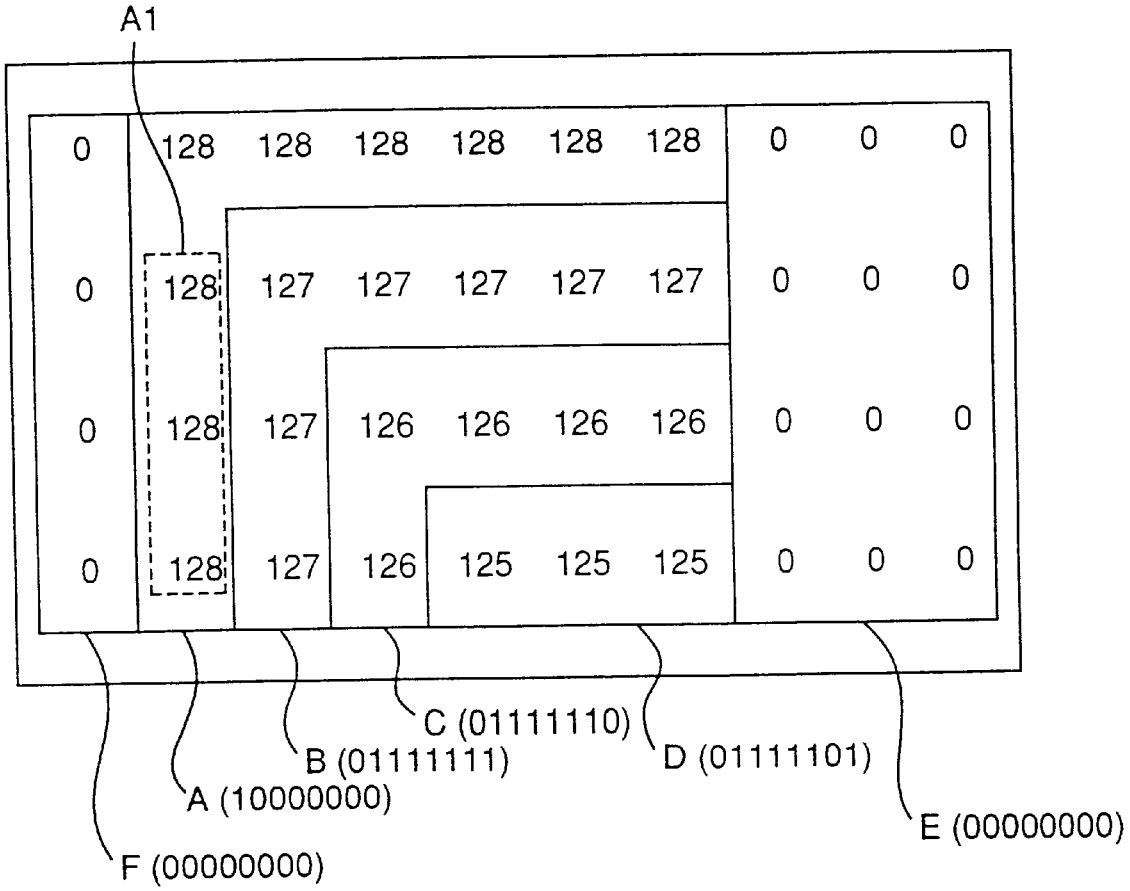
FIG. 5 shows a diagram similar to FIG. 3, but particularly showing a case in which 1 pixel moved from the PDP screen brightness distribution of FIG. 3.

For a 2.25-times mode, the respective number of light emissions of subfields SF1 through SF10 is set using a value that results from multiplying by 3 the weighting value indicated in the 1.25-times mode of FIG. 5. Similarly, for a 2.50-times mode, a 2.75-times mode, a 3.00-times mode, the respective number of light emissions of subfields SF1 through SF10 is set using a value that results from multiplying by 3 the weighting values indicated in the respective multiplier modes thereof of FIG. 5.

In this way, by selecting a weighting value in FIG. 5 for a value such as that described above, a number of light emissions that corresponds to each multiplier mode can be set, without performing rounding off processing, by simply multiplying by 2 a weighting value of FIG. 5 for a 1.25-times mode, a 1.50-times mode, a 1.75-times mode, a 2.00-times mode. And for a 2.25-times mode, a 2.50-times mode, a 2.75-times mode, a 3.00-times mode, a number of light emissions that corresponds to each multiplier mode can be set, without performing rounding off processing, by simply multiplying by 3 a weighting value of FIG. 5.

Table 7 is read the same as Table 3. That is, a value arrived at by subtracting the number of light emissions in the 1.00-times mode row indicated in Table 6 from a value, which is the number of light emissions of the multiplier mode of the next row (that is, the 1.25-times mode), and which is in an adjacent location, is indicated in the 1.00-times mode row of Table 7.

Table 8 is read the same as Table 4. That is, the percentage of the difference of the number of light emissions indicated in Table 7, relative to the total number of light emissions indicated in Table 6, is listed in Table 8. The number of light emissions of Table 6, and the weighting values of Table 5 are set so that all values work out to less than 6% in Table 8.

Thus, because the difference between adjacent multiplier modes, and the difference of the number of light emissions between subfields, which are lined up in order from those with the largest weighting values, are reduced to less that 6%, since there is no great change in the number of light emissions, brightness can be changed smoothly when moving from a certain image to a next image, even if a multiplier mode changes.

These Table 5-Table 8 can be utilized with any of the embodiments.

Fourth Embodiment

Figure 16:
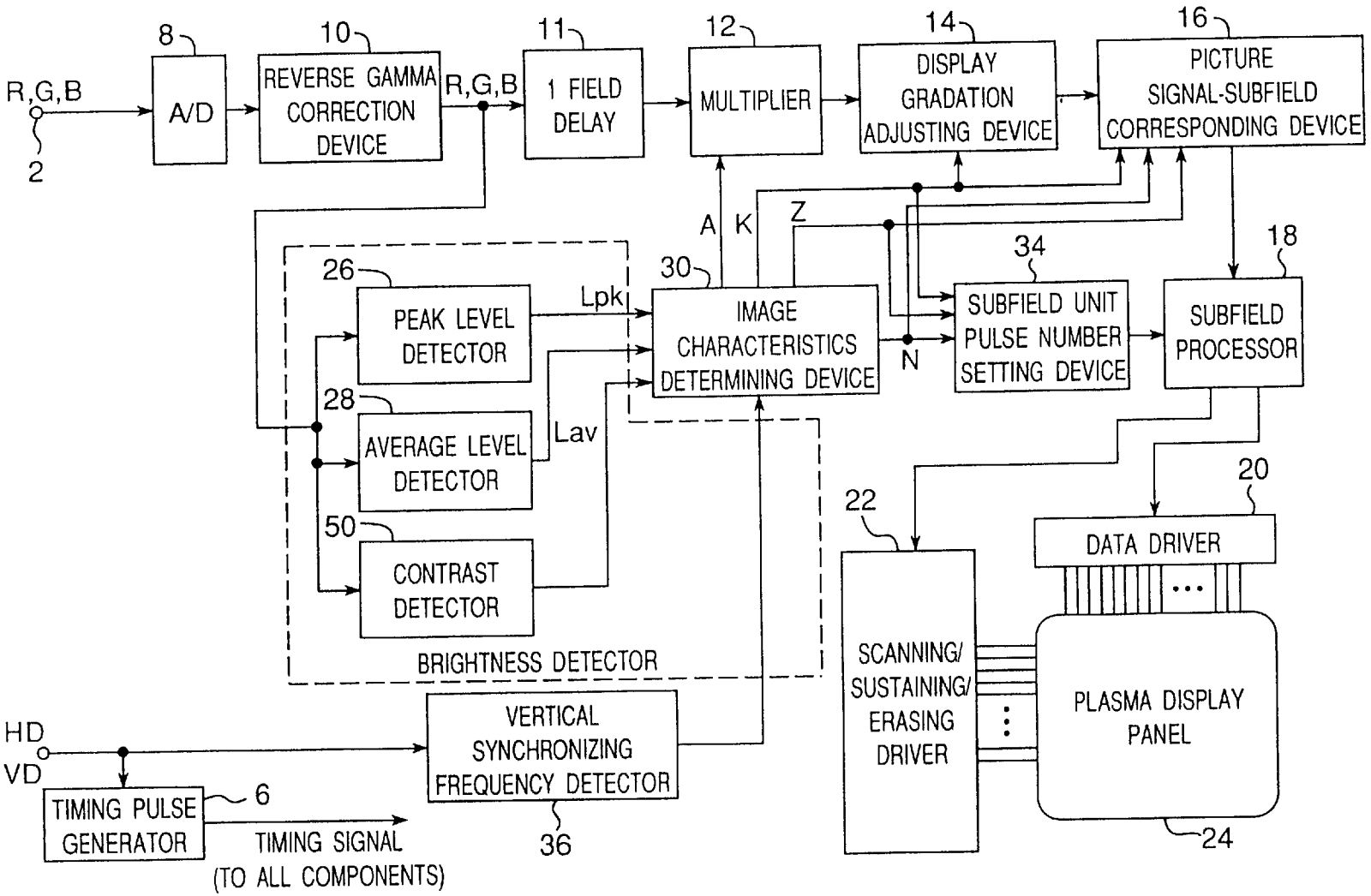
FIG. 16 is a block diagram of a display apparatus of a fourth embodiment.

FIG. 16 shows a block diagram of a display apparatus of a fourth embodiment. This embodiment further provides to the embodiment of FIG. 9 a contrast detector 50 in parallel with the average level detector 28. An image characteristic determining device 30 determines the 4 parameters on the basis of image contrast in addition to the peak level Lpk and average level Lav, or in place thereof. For example, when contrast is intense, this embodiment can decrease the fixed multiplication factor A.

Fifth Embodiment

Figure 17:
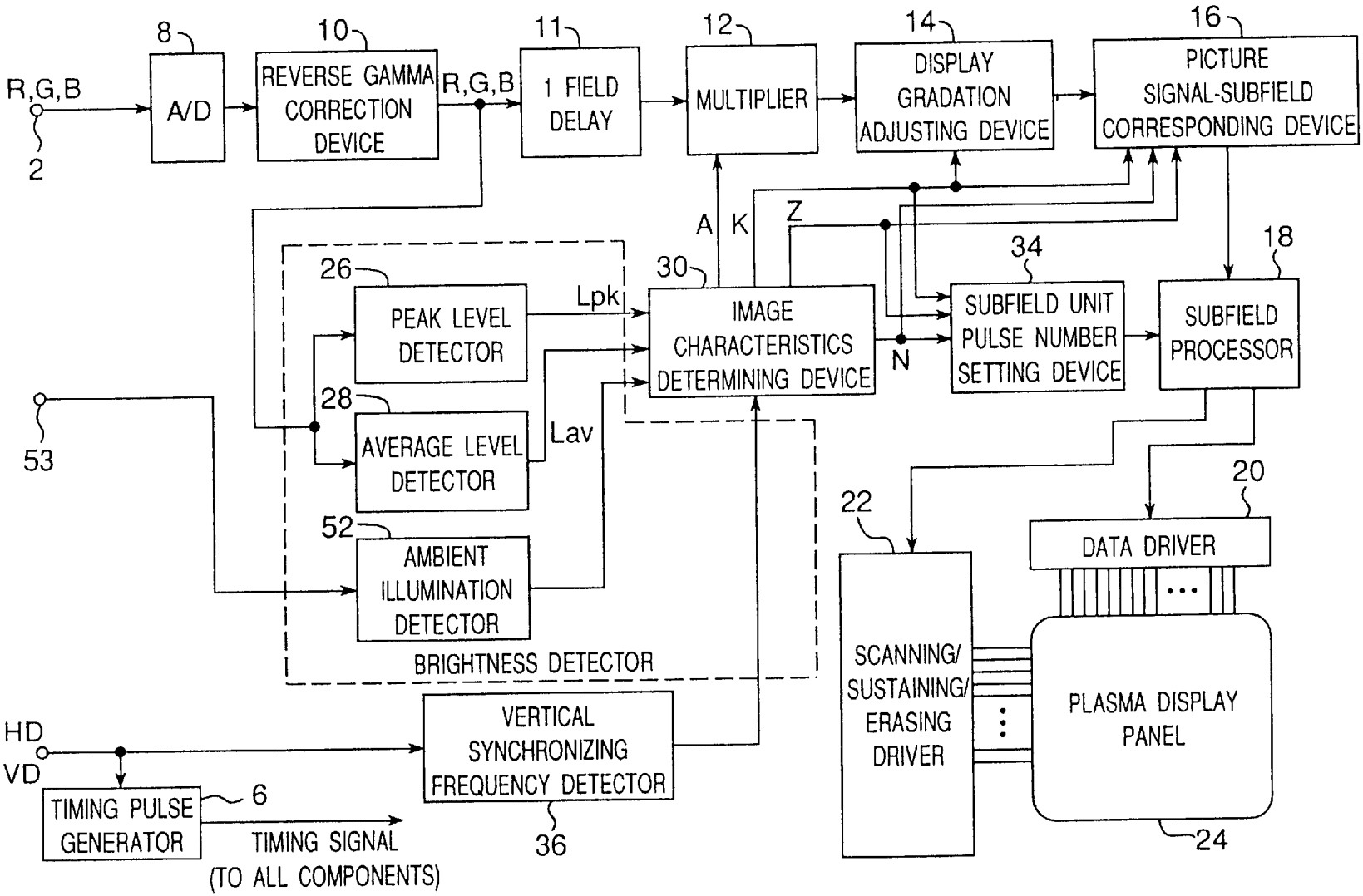
FIG. 17 is a block diagram of a display apparatus of a fifth embodiment.

FIG. 17 shows a block diagram of a display apparatus of a fifth embodiment. This embodiment further provides to the embodiment of FIG. 9 an ambient illumination detector 52. The ambient illumination detector 52 receives a signal from ambient illumination 53, outputs a signal corresponding to ambient illumination, and applies it to an image characteristic determining device 30. The image characteristic determining device 30 determines 4 parameters on the basis of ambient illumination in addition to the peak level Lpk and average level Lav, or in place thereof. For example, when ambient illumination is dark, this embodiment can decrease the fixed multiplication factor A.

Sixth Embodiment

Figure 18:
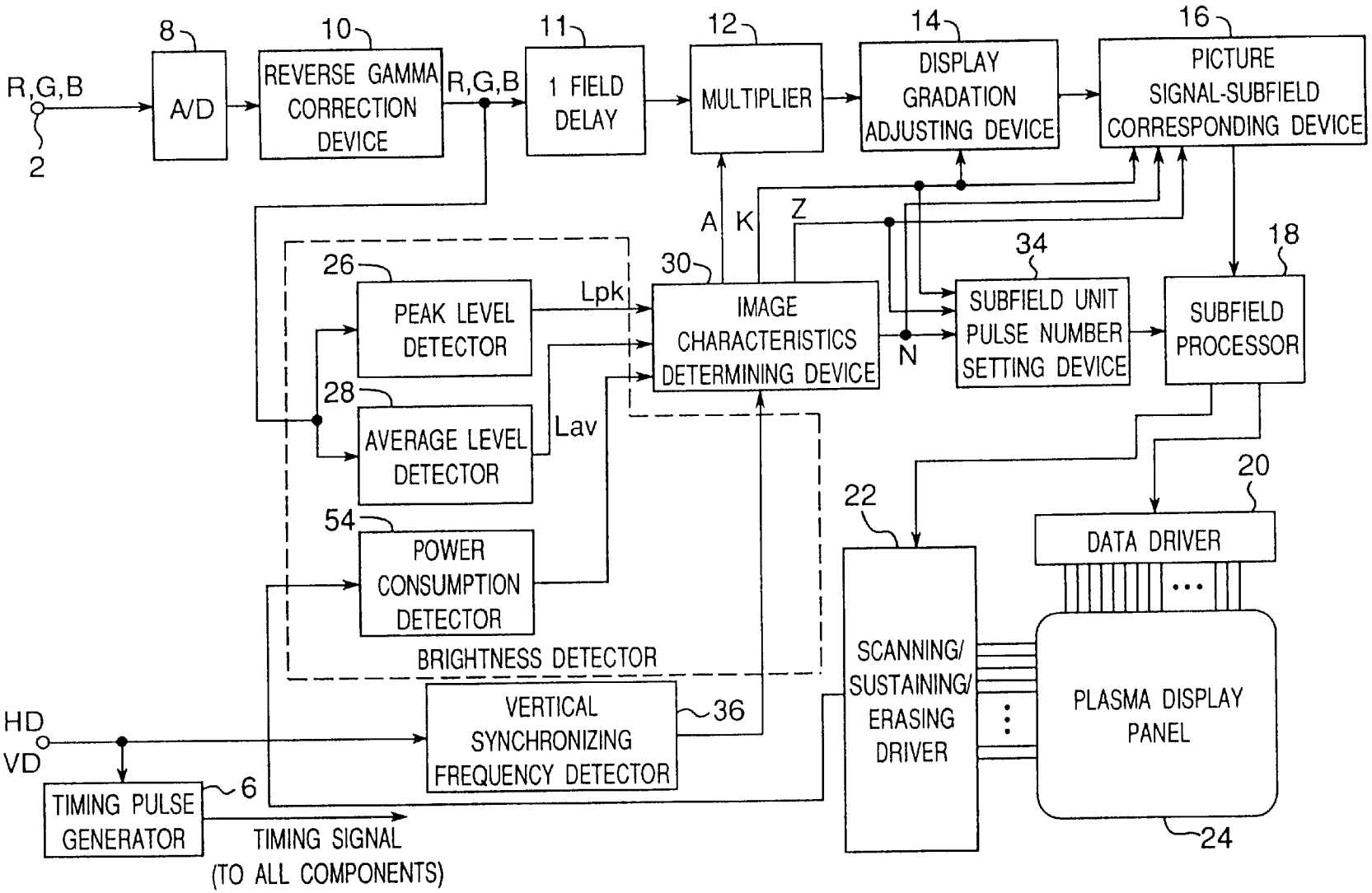
FIG. 18 is a block diagram of a display apparatus of a sixth embodiment.

FIG. 18 shows a block diagram of a display apparatus of a sixth embodiment. This embodiment further provides to the embodiment of FIG. 9 a power consumption detector 54. The power consumption detector 54-outputs a signal corresponding to the power consumption of a plasma display panel 24, and drivers 20, 22, and applies it to an image characteristic determining device 30. The image characteristic determining device 30 determines 4 parameters on the basis of the power consumption of plasma display panel 24, in addition to the peak level Lpk and average level Lav, or in place thereof. For example, when power consumption is great, this embodiment can decrease the fixed multiplication factor A.

Seventh Embodiment

Figure 19:
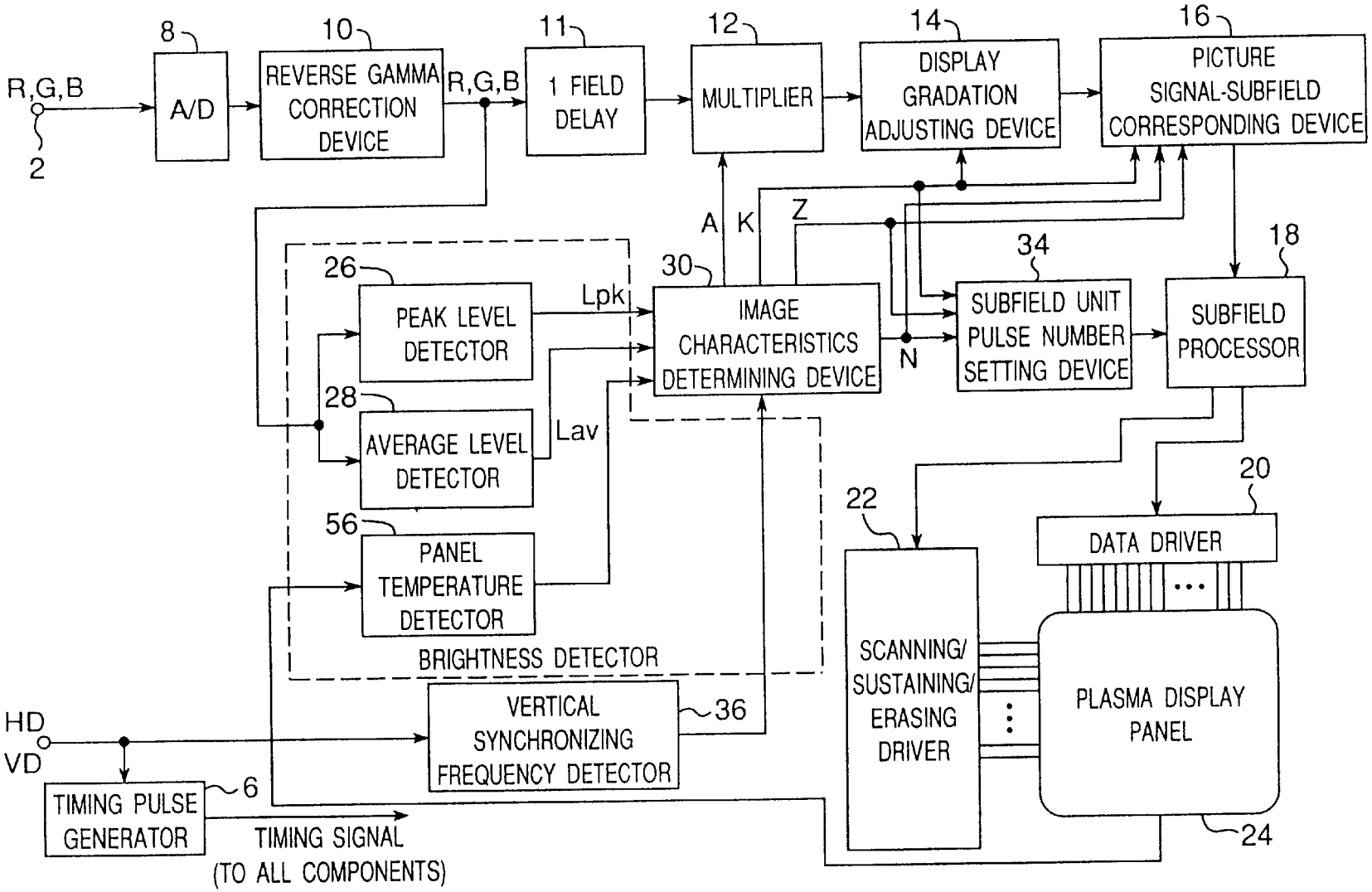
FIG. 19 is a block diagram of a display apparatus of a seventh embodiment.

FIG. 19 shows a block diagram of a display apparatus of a seventh embodiment. This embodiment further provides to the embodiment of FIG. 9 a panel temperature detector 56. The panel temperature detector 56 outputs a signal corresponding to the temperature of a plasma display panel 24, and applies it to an image characteristic determining device 30. The image characteristic determining device 30 determines 4 parameters on the basis of the temperature of plasma display panel 24, in addition to the peak level Lpk and average level Lav, or in place thereof. For example, when temperature is high, this embodiment can decrease the fixed multiplication factor A.

Eighth Embodiment

For the above-described embodiments, the method for setting the number of light emissions E for each pixel, when the brightness of each of these pixels is multiplied 1.25 times, 1.50 times, 1.75 times, 2.00 times, 2.25 times, 2.50 times, 2.75 times, 3.00 times, makes use of the formula, $$E=Q\times N$$

and when a fractional value is included in the calculation results of a number of light emissions E, a rounding off to the nearest whole number, or similar process, is used so that the number of light emissions E is always set at a whole number.

In this eighth embodiment, a number of light emissions E is set for each pixel, and for peripheral pixels of each of these pixels, when the brightness of each of these pixels is multiplied 1.25 times, 1.50 times, 1.75 times, 2.00 times, 2.25 times, 2.50 times, 2.75 times, 3.00 times. That is, if it is assumed that the calculation results of the number of light emissions E of a certain noted pixel is 3.75, since the actual number of light emissions possible in the vicinity above and below 3.75 is 3 times, and 4 times, by distributing the number of light emissions to peripheral pixels, which include the noted pixel, at a ratio calculated at 3 times, and 4 times, it is possible to set the brightness of the noted pixel circumference to a brightness by which the number of light emissions becomes 3.75. Thus, errors in a noted pixel are distributed to peripheral pixels, and a method for reducing errors is called an error diffusion method. That is, an error diffusion method is utilized in this eighth embodiment.

Figure 20:
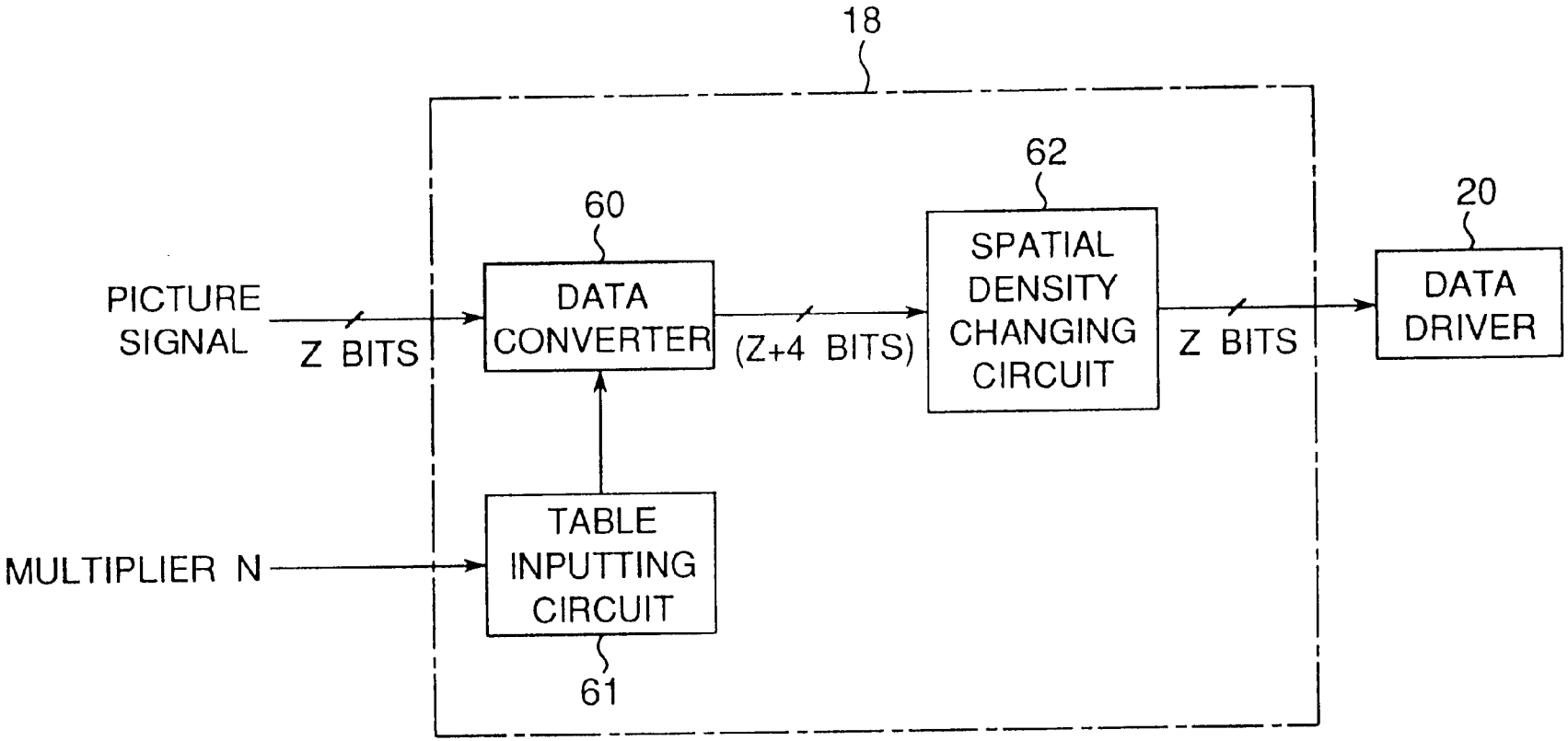
FIG. 20 is a block diagram of a display apparatus of a eighth embodiment.

FIG. 20 shows a block diagram of an eighth embodiment. 60 is a data converter, 61 is a table inputting circuit, 62 is a spatial density changing circuit, and these 60, 61, 62 are included in a subfield processor 18.

A weighting multiplier N is inputted to the table inputting circuit 61, and it holds a correction data conversion table for each of the different multipliers N (1.25-times, 1.50 times, 1.75 times, 2.00 times, 2.25 times, 2.50 times 2.75 times, 3.00 times). It outputs a correction data conversion table that corresponds to an inputted multiplier N. The creation of a correction data conversion table is explained here.

Now, consider a multiplier N of 1.25 times. If the circumstances listed in Table 1, Table 2 are taken as examples, the weighting value Q and number of light emissions E of subfields SF1–SF11 are as shown in Table 9 below.

TABLE 9

| | SF1 | SF2 | SF3 | SF4 | SF5 | SF6 | SF7 | SF8 | SF9 | SF10 | SF11 |
|---|---|---|---|---|---|---|---|---|---|---|---|
| Q | 1 | 2 | 4 | 8 | 12 | 19 | 26 | 35 | 42 | 49 | 57 |
| E | 1 | 3 | 5 | 10 | 15 | 24 | 33 | 44 | 53 | 61 | 71 |

Further, when luminance to be displayed from 0 gradation to 10 gradations, number of light emissions, correction data are shown, it is as shown in Table 10 below.

TABLE 10

| L | D | E | C |
|---|---|---|---|
| 0 | 0.00 | 0 | 0.000 |
| 1 | 1.25 | 1 | 1.125 |
| 2 | 2.50 | 3 | 1.750 |
| 3 | 3.75 | 4 | 2.750 |
| 4 | 5.00 | 5 | 4.000 |
| 5 | 6.25 | 6 | 5.125 |
| 6 | 7.50 | 8 | 5.750 |
| 7 | 8.75 | 9 | 6.750 |
| 8 | 10.00 | 10 | 8.000 |
| 9 | 11.25 | 11 | 9.125 |
| 10 | 12.50 | 13 | 9.750 |

Here, L is gradation, D is the luminance to be displayed, E is the number of light emissions, and C is correction data. The luminance to be displayed D becomes L×N (for the above-mentioned example, N=1.25). Further, the number of light emissions E is the result of determining a gradation L by adding the weighting value of one or a plurality of subfields from Table 9, and adding a number of light emissions that corresponds-thereto. For example, in the case of gradation 10, it is generated by adding subfields SF2, SF4, and the number of light emissions at that time is a value that adds together the number of light emissions of subfields SF2, SF4, that is, 13. Further, correction data C for a certain gradation La is determined as follows.

With regard to a luminance to be displayed for a gradation La (La×N), the closest number of light emissions on the upside Fu, and the closest number of light emissions on the downside Fd are determined, and for this to-be-displayed luminance (La×N), the ratio of internal division x: (1−x) between Fu and Fd is determined.

If this is expressed as a formula, it becomes $$Fu(x+Fd((1-x)=(La\times N) \quad (1)$$

that is, $$x=\{(La\times N)-Fd\}/(Fu-Fd) \quad (2)$$

Further, if a gradation for a number of light emissions Fd is expressed as L(Fd), correction data C is determined by the following formula.

$$C=L(Fd)+x \quad (3)$$

The significance of this formula is manifest in the fact that the number of light emissions Fu of a gradation L(Fu) becomes effective in the area of peripheral portion ×100(%), and the number of light emissions Fd of a gradation L(Fd) becomes effective in the area of peripheral portion (1−x) 100(%).

Correction data C for gradation 5 is determined.

Luminance to be displayed for gradation 5 is 6.25 (=5×1.25). The closest light emission number on the upside (Fu) for 6.25 is 8 (corresponding to gradation 6), and the closest light emission number on the downside (Fd) for 6.25 is 6 (corresponding to gradation 5). For to-be-displayed luminance 6.25, the internal division ratio x:(1−x) between 8 and 6 is determined.

If this is expressed as a formula, it becomes $$8x+6(1-x)=6.25$$

that is, $$x=(6.25-6)/2=0.125$$

Further, since the gradation for light emission number Fd, that is, light emission number 6, is 5, correction data C is determined by the following formula.

$$C=L(Fd)+x=5+0.125=5.125$$

The significance of this formula is manifest in the fact that the number of light emissions Fu, that is, 8, of a gradation L(Fu), that is, gradation 6, becomes effective in the area of peripheral portion ×100(%), that is, 12.5%, and the number of light emissions Fd, that is, 6, of a gradation L(Fd), that is, gradation 5, becomes effective in the area of peripheral portion (1−x)100(%), that is, 87.5%.

As another example, correction data C for gradation 6 is determined. Luminance to be displayed for gradation 6 is 7.50 (=6×1.25). The closest light emission number on the upside (Fu) for 7.50 is 8 (corresponding to gradation 6), and the closest light emission number on the downside (Fd) for 7.50 is 6 (corresponding to gradation 5). For to-be-displayed luminance 7.50, the internal division ratio x:(1−x) between 8 and 6 is determined.

If this is expressed as a formula, it becomes $$8x+6(1-x)=7.50$$

that is, $$x=(7.50-6)/2=0.750$$

Further, since the gradation for light emission number Fd, that is, light emission number 6, is 5, correction data C is determined by the following formula.

$$C=L(Fd)+x=5+0.750=5.750$$

The significance of this formula is manifest in the fact that the number of light emissions Fu, that is, 8, of a gradation L(Fu), that is, gradation 6, becomes effective in the area of peripheral portion ×100(%), that is, 75%, and the number of light emissions Fd, that is, 6, of gradation L(Fd), that is, gradation 5, becomes effective in the area of peripheral portion (1−x)100(%), that is, 25%.

Thus, with regard to a 1.25-times weighting multiplier, correction data is determined for all gradations 0–255, and this is shown in Table 11. A correction data conversion table for a 1.25-times weighting multiplier is prepared.

TABLE 11

| L | C |
|---|---|
| 0 | 0.000 |
| 1 | 1.125 |
| 2 | 1.750 |
| 3 | 2.750 |
| 4 | 4.000 |
| 5 | 5.125 |
| 6 | 5.750 |
| 7 | 6.750 |
| 8 | 8.000 |
| 9 | 9.125 |
| 10 | 9.750 |
| : | : |
| : | : |
| 255 | 254.750 |

Further, a correction data conversion table can be prepared for a 1.50-times, 1.75-times, 2.00-times, 2.25-times, 2.50-times, 2.75-times, 3.00-times weighting multiplier N in the same manner. Thus, of a prepared plurality of correction data conversion tables, an appropriate one is selected in the table inputting circuit 61 in accordance with the inputted multiplier N, and sent to the data converter 60.

Data converter 60 receives a picture signal comprising a gradation signal represented in Z bits, converts it to correction data in accordance with a conversion table, and outputs correction data, which is presented in (Z+4) bits. The upper Z bits represent the integer portion, and the lower 4 bits represent the fraction portion. This correction data is sent to the spatial density changing circuit 62, and peripheral pixel adjustment is performed on the basis of correction data. As the circuit for realizing the spatial density changing circuit 62, there are cases in which a dither circuit is used, and cases in which an error diffusing circuit is used. First, a dither circuit is explained.

Figure 21:
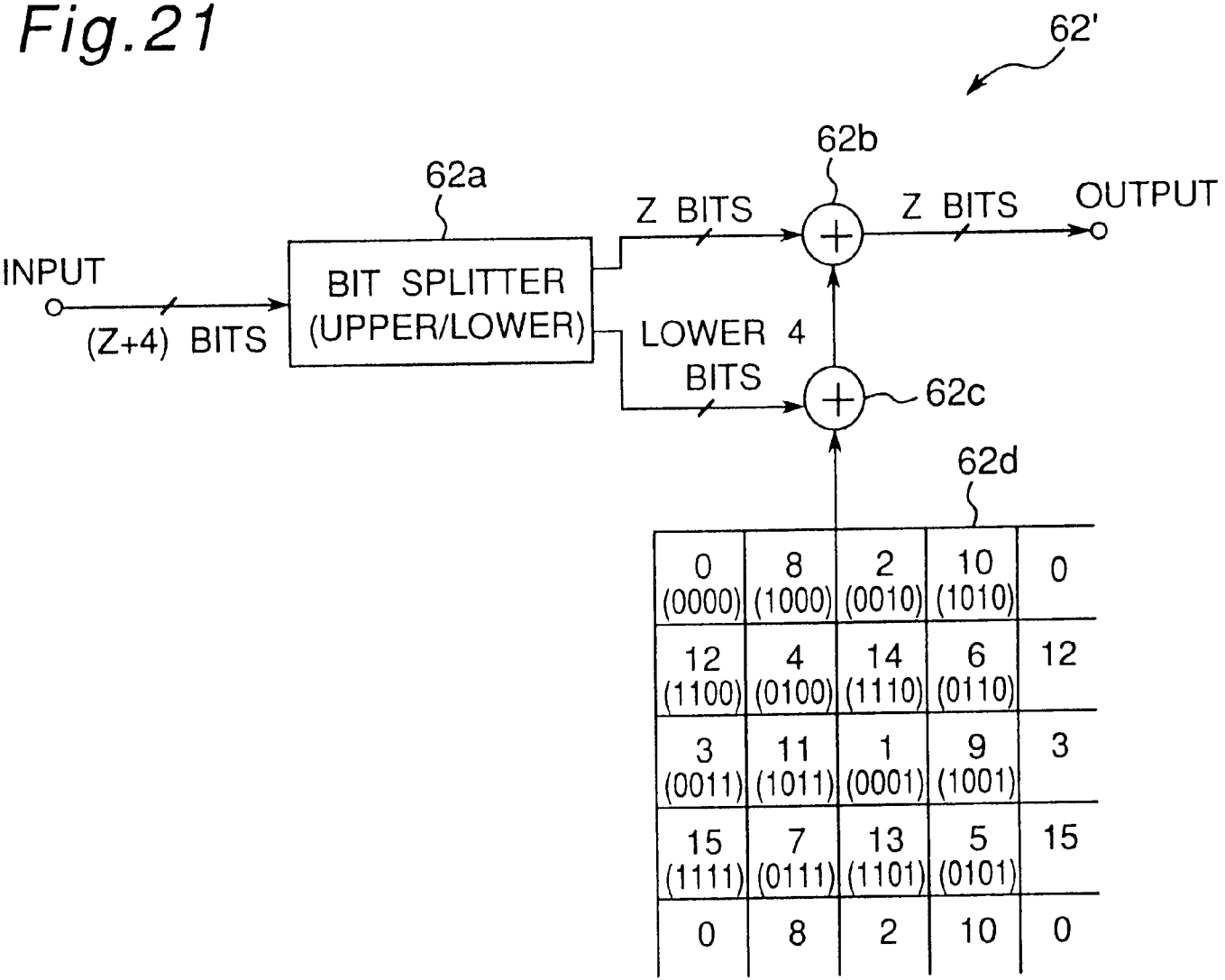
FIG. 21 is a block diagram of a dither circuit.

FIG. 21 shows a block diagram of a dither circuit 62', which is one mode of spatial density changing circuit 62.

Dither circuit 62' comprises a bit splitter 62*a*, an adder 62*b*, an adder 62*c*, a Bayer pattern 62*d*. A Bayer pattern 62*d* randomly positions numerical values from 0 (0000) to 15 (1111) in a 4×4 block of 16 pixels, and repeats the same pattern in the vertical direction, horizontal direction, developing over an entire screen.

A bit splitter 62*a* divides inputted correction data into an upper Z bits, and a lower 4 bits. The lower 4 bits are sent to adder 62*c*, and are added to 4-bit data of a corresponding location pixel, which is sent from the Bayer pattern 62*d*. If the addition result gives rise to a carry from the lower 4 bits to the 5th bit, a carry occurs, and "1" is added in adder 62*b* to the least significant bit of Z bits.

For example, assume that the inputted picture signal is a partially uniform luminance level, for example, a level 5, and the weighting multiplier N at that time is 1.25. In this case, all correction data inputted to the bit splitter 62*a* for this uniform portion is 5.125. Here, 0.125 becomes the 4-bit display (0010), as shown in FIG. 22B. These 4 bits are sent to adder 62*c* as the lower 4 bits, and are added to the 4-bit data of the Bayer pattern 62*d* being sent from each pixel on the screen.

When a correction data fraction is 0.125, the carry resulting from the adding thereof to Bayer pattern 4-bit data is caused by 2 pixels (portion represented by "1") in a 4×4 16 pixel block, as shown in FIG. 22B. In the above-described example, as for this 2 pixel portion, "1" is added in adder 62*b*, and the Z bit portion moves up from 5 to 6. Therefore, from Table 10, such a 2 pixel portion results in a light emission number of 8. As for the remaining 14 pixels (portion represented by "0" in FIG. 22B), since there is no carry in adder 62*b*, the Z bit portion remains 5 as-is. Therefore, from Table 10, such a 14 pixel portion results in a light emission number of 6. As a result of this, overall luminance for a 4×4 16 pixel block works out to 6.25.

In FIG. 22 (A) through (H), the carry position when the fractional value of correction data is 0.000, 0.125, 0.250, 0.375, 0.500, 0.625, 0.750, 0.875 is represented by "1."

Figure 23:
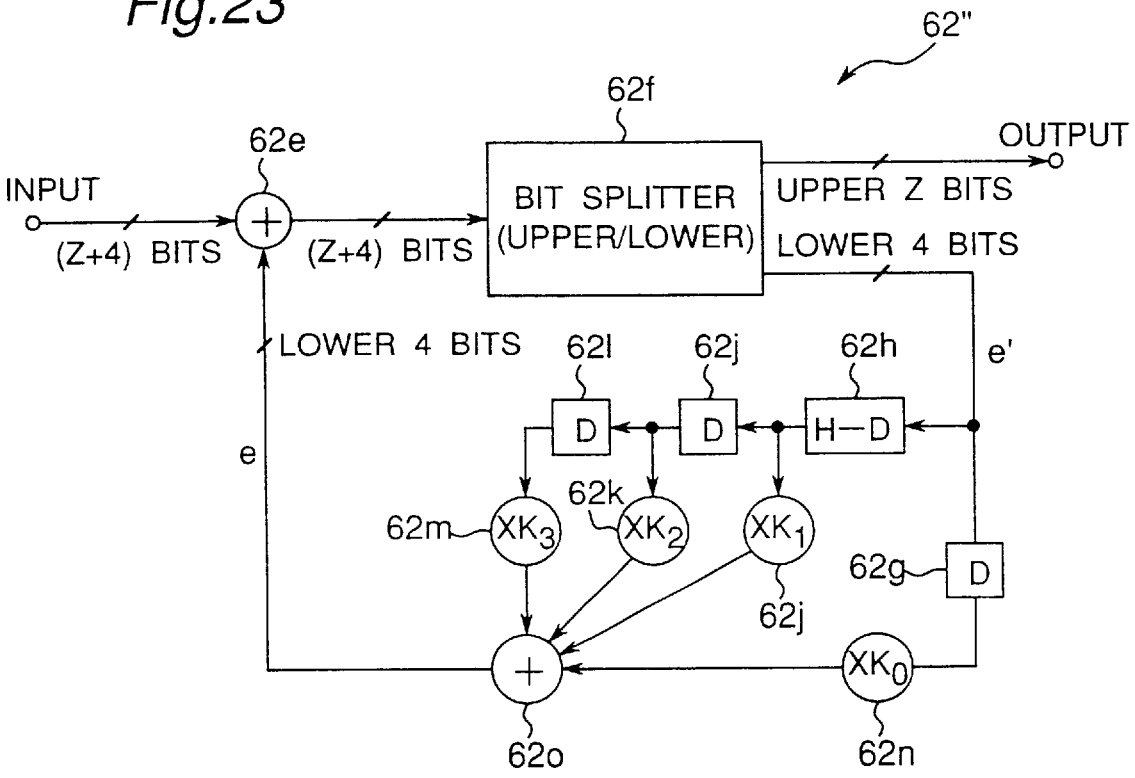
FIG. 23 is a block diagram of an error diffusing circuit.

FIG. 23 shows a block diagram of an error diffusing circuit 62", which is another mode of spatial density changing circuit 62. Error diffusing circuit 62" comprises adder 62*e*, bit splitter 62*f*, 1 pixel delay 62*g*, 62*j*, 62*l*, (1 horizontal time−1 pixel) delay 62*h*, multiplier 62*i*, 62*k*, 62*m*, 62*n*, adder 62*o*. In multipliers 62*i*, 62*k*, 62*m*, 62*n*, a multiplicand is multiplied by k1, k2, k3, k4. As for the value of k1, k2, k3, k4, a value, which satisfies k1+k2+k3+k4=1 is adopted, for example, there is k1=k2=k3=k4=¼.

Figure 24A:
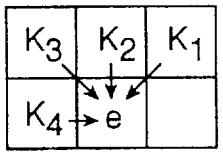
FIGS. 24A and 24B are diagrams showing error accumulation and error diffusion, respectively.

In multiplier 62*i*, a fractional value of correction data of a (1 horizontal time−1 pixel) time-delayed pixel relative to the current pixel is multiplied by k1 (=¼). In FIG. 24A, if it is assumed that the current pixel is represented by e, with regard to the pixel in K1, the fractional value of correction data is multiplied by k1 (=¼).

In multiplier 62*k*, a fractional value of correction data of a 1 horizontal-time-delayed pixel, that is, the pixel in k2 of FIG. 24A, relative to the current pixel is multiplied by k2 (=¼). In multiplier 62*m*, a fractional value of correction data of a (1 horizontal+1 pixel) time-delayed pixel, that is, the pixel in k3 of FIG. 24A, relative to the current pixel is multiplied by k3 (=¼). In multiplier 62*n*, a fractional value of correction data of a 1 pixel time-delayed pixel, that is, the pixel in k4 of FIG. 24A, relative to the current pixel is multiplied by k4 (=¼).

In this way, data multiplied by k1, k2, k3, k4 is added in adder 62*o*, and the sum (4-bit data) thereof is added in adder 62*e* to the lower 4 bits of newly inputted correction data.

For example, assume an inputted picture signal has a partially uniform luminance level, and the fractional value of correction data is 0.500 (8 in hexadecimal) at this time. In this case, as shown in FIG. 25A, the lower 4 bits of correction data inputted into adder 62*e* relative to each pixel on a screen becomes 8. This lower 4-bits 8 is added in adder 62*e*, and is outputted as a value that, in most cases, differs from that outputted by the bit splitter 62*f*. The value outputted by the bit splitter 62*f* is indicated in FIG. 25B.

In FIG. 25*b*, the value of the lower 4-bits following addition of locations (X,Y)=(3, 2) is 16. The following calculations are performed in adder 62*o*.

$$1\tfrac{1}{4}+1\tfrac{1}{4}+1\tfrac{7}{4}+1\tfrac{1}{4}=2+3+0+3=8$$

Here, fractions are omitted for each item. Further, since 1⁷⁄₄ becomes ¼ by performing subtractions for the carried portion 16, by omitting the fraction, it becomes 0. Furthermore, 8, which is the lower 4 bits of correction data newly inputted by adder 62*e*, is added to 8, the calculation result of adder 62*o*, making 16.

Calculation of the lower 4 bits is carried out for all pixels in this manner, and when the calculation result is 16 or higher, a carry is performed, and "1" is entered, and when this result is less than 16, "0" remains as-is. In FIG. 25C, a "1" is indicated in a portion for which a carry was performed, and a "0" is indicated in a portion for which there was no carry. As is clear from FIG. 25C, when the fractional value of correction data is 0.500, the ratio of "0" and "1" is split about fifty—fifty.

Figure 24B:
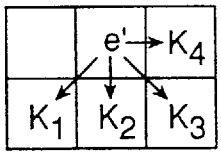

When an error diffusing circuit 62" is utilized, as shown in FIG. 24A, errors from peripheral pixels following a calculation process for a certain noted pixel, are accumulated in the noted pixel. Conversely, as shown in FIG. 24B, the errors of pixel e' following a certain calculation process are diffused to pixels, which are to be calculated thereafter.

Ninth Embodiment

Figure 26:
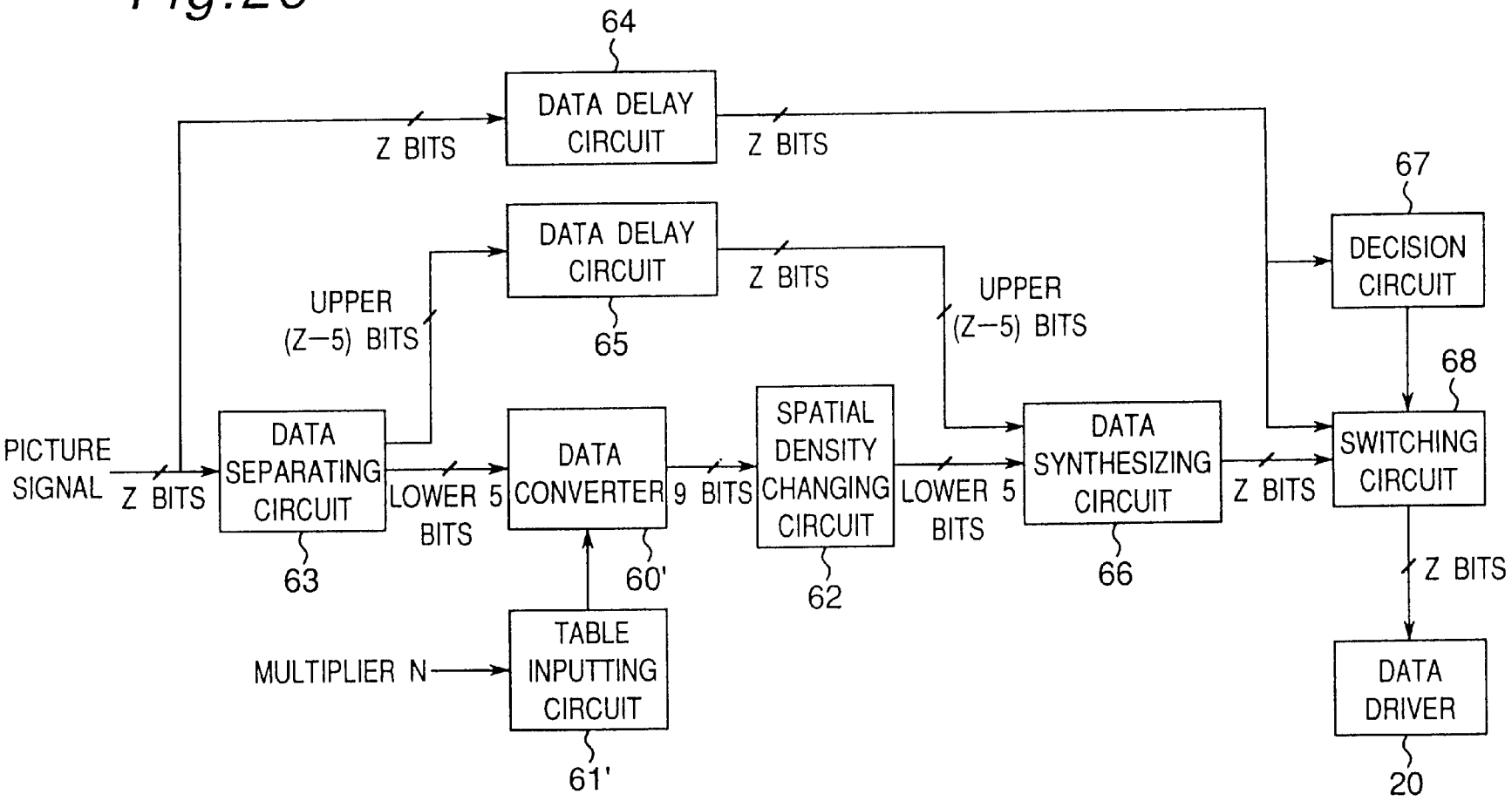
FIG. 26 is a block diagram of a display apparatus of a ninth embodiment.

FIG. 26 shows a ninth embodiment, an improvement on the eighth embodiment of FIG. 20. 60' is a data converter, and 61' is a table inputting circuit, and both differ somewhat from those of FIG. 20. 62 is a spatial density changing circuit, and is the same as that on FIG. 20. In the table inputting circuit 61 in FIG. 20, correction data for gradation 1 through gradation 255 for each multiplying factor was prepared as shown in Table 11, but in the embodiment of FIG. 26, correction data is only prepared for gradation 1 through gradation 31 for each multiplying factor. In accordance with this, the size of a table can be greatly reduced. Further, for data converter 60' as well, data can be held in a small memory.

Newly added portions in FIG. 26 are a data separating circuit 63, data delay circuit 64, 65, data synthesizing circuit 66, decision circuit 67, switching circuit 68.

An inputted Z-bit luminance signal is sent to data delay circuit 64, and a delay, that is the same time as the processing time for blocks 63, 60', 62, 66, is performed.

In the decision circuit 67, a decision is made as to whether or not upper (Z-5) bits are all 0. When they are all 0, then it decides whether the inputted Z-bit luminance signal is equivalent or higher than gradation 32, or less than gradation 32. When the upper (Z-5) bits are all 0 (when it is less than gradation 32), the switching circuit 68 switches to the connection indicated by a solid line, and when any of the upper (Z-5) bits is a 1 (when it is equivalent to, or greater than gradation 32), the switching circuit 68 switches to the connection indicated by a dotted line.

In data delay circuit 65, a delay, that is the same time as the processing time for blocks 60', 62, is performed.

The data separating circuit 63 separates an inputted Z-bit luminance signal into upper (Z-5) bits and lower 5 bits. Data converter 60' converts the lower 5 bits into 9-bit correction data for gradation 1 through gradation 31. The correction data converted to 9 bits is once again converted to 5 bits when spatial density is changed in accordance with error diffusion and the like. In the data synthesizing circuit 66, upper (Z-5)-bit data delayed by data delay circuit 65 is synthesized with lower 5-bit data from spatial density changing circuit 62, and Z-bit data is generated.

Z-bit data from data synthesizing circuit 66 is selected by switching circuit 68 for luminance signals from gradation 1 to gradation 31, and Z-bit data from data delay circuit 64 is selected for luminance signals greater than gradation 32.

Because data delayed by data delay circuit 65, and put to effective use, is nothing but (Z-5)-bit 0 data, data delay circuit 65 can be omitted, and a circuit, which generates nothing but (Z-5)-bit 0 data, can be provided, and connected to data synthesizing circuit 66.

In accordance with the constitution shown in FIG. 26, by restricting correction to a low luminance portion (in the embodiment, less than 31 gradations), it is possible to reduce the capacity of a data conversion table, and data processing can also be reduced. When luminance is 32 gradations or greater, since the difference of displayable luminance according to the luminance to be displayed and the number of light emissions works out to less than 3%, sufficient performance can be achieved without using correction data.

Effects of the Invention

As described in detail above, a display apparatus related to the present invention, by performing adjustments by changing an N-multiplier mode value N on the basis of screen brightness data using not only an integer multiplier, but also a multiplier of a value comprising a fraction, enables screen brightness adjustment that continuously brightens without intermittent brightness, so that a person watching the screen hardly notices a change in brightness.

Further, by using a spatial density changing circuit, it becomes possible to diffuse errors to peripheral pixels. In accordance with this, because it is possible to correct an extremely slight residual brightness change when performing adjustments by changing an N-multiplier mode value N on the basis of screen brightness data using not only an integer multiplier, but also a multiplier of a value comprising a fraction, the extremely slight brightness change that remains in a particularly low luminance portion can be further reduced.

What is claimed is:

1. A display apparatus for creating, for each image, a number of subfields Z from a first subfield to a Zth subfield in accordance with a Z bit representation of each pixel, a weighing value for each subfield, and a number of gradation display points, the display apparatus comprising:

a peak level detector that detects a peak image brightness level;

an average level detector that detects an average image brightness level;

an image characteristic determining device that determines a weighing multiple including a positive integer part and a fractional part, based on the peak image brightness level and the average image brightness level; and a pulse number setting device that multiples the weighing multiple by the weighing value of each subfield to obtain a product capable of having a positive integer part and a fractional part, and that defines an integer value near the product as a number of drive pulses for each subfield;

wherein the image characteristic determining device increases the weighing multiple as the average image brightness level decreases and as the peak image brightness level increases.

2. The display apparatus according to claim 1, wherein the pulse number setting device defines the integer value by rounding a fractional value of the product to the closest integer value.

3. The display apparatus according to claim 1, wherein the pulse number setting device defines the integer value by rounding a fractional value of the product to the next lowest integer.

4. The display apparatus according to claim 1, wherein the pulse number setting means defines the integer value by rounding a fractional value of the product to the next highest integer.

5. The display apparatus according to claim 1, further comprising:

a system that generates, for each gradation, correction data for an error between a luminance of an image to be displayed and a displayable luminance defined in accordance with the number of drive pulses for each subfield;

a system that changes a spatial density of a gradation to be displayed, in accordance with the correction data.

6. A display apparatus according to claim 5, the system changing spatial density comprises a dither circuit.

7. A display apparatus according to claim 5, the system changing spatial density comprises an error diffusing circuit.

8. A display apparatus according to claim 5, wherein the luminance of the image to be displayed is determined, for each gradation, by multiplying the weighing multiple by each gradation, and wherein the displayable luminance is determined by selecting the weighing value of at least one subfield to obtain a desired gradation and summing the drive pulses corresponding to the at least one subfield.

9. The display apparatus according to claim 1, wherein the display apparatus further produces a multiplication factor for amplifying an image signal.

10. A method for controlling a display apparatus that creates, for each image, a number of subfields Z from a first subfield to a Zth subfield in accordance with a Z bit representation of each pixel, a weighing value for each subfield, and a number of gradation display points, the method comprising:

detecting a peak image brightness level;

detecting an average image brightness level;

determining a weighing multiple including a positive integer part and a fractional part, based on the peak image brightness level and the average image brightness level, the determined weighing multiple increasing as the average image brightness level decreases and as the peak image brightness level increases;

multiplying the weighing multiple by the weighing value of each subfield to obtain a product capable of having a positive integer part and a fractional part;

defining an integer value near the product, as a number of drive pulses for each subfield.

11. The method for controlling a display apparatus according to claim 10, further comprising defining the integer value by rounding the fractional value of the product to the closest integer value.

12. The method for controlling a display apparatus according to claim 10, further comprising defining the integer value by rounding the fractional value of the product to the next lowest integer.

13. The method for controlling a display apparatus according to claim 10, further comprising defining the integer value by rounding the fractional value of the product to the next highest integer.

14. The method for controlling a display apparatus according to claim 10, further comprising:

determining, for each gradation, a luminance of an image to be displayed;

defining, for each gradation, a displayable luminance in accordance with the number of drive pulses for each subfield;

generating, for each gradation, correction data for an error between the luminance of the image to be displayed and the displayable luminance; and changing a spatial density of a gradation to be displayed, in accordance with the correction data.

15. The method for controlling a display apparatus according to claim 14, wherein the changing changes the spatial density by using a dither circuit.

16. The method for controlling a display apparatus according to claim 14, wherein the changing changes the spatial density by using an error diffusing circuit.

17. The method for controlling a display apparatus according to claim 14, wherein the determining determines the luminance of the image to be displayed by multiplying the weighing multiple by each gradation, and wherein the defining defines the displayable luminance by selecting the weighing value of at least one subfield to obtain a desired gradation and summing the drive pulses corresponding to the at least one subfield.

18. The method for controlling a display apparatus according to claim 10, further comprising producing a multiplication factor for amplifying an image signal.

* * * * *